US007306042B2

(12) United States Patent
Bansal et al.

(10) Patent No.: US 7,306,042 B2
(45) Date of Patent: Dec. 11, 2007

(54) METHOD FOR COMPLETING A WELL USING INCREASED FLUID TEMPERATURE

(75) Inventors: R. K. Bansal, Houston, TX (US); David J. Brunnert, Cypress, TX (US); Michael Brian Grayson, Sugar Land, TX (US); James Ken Whanger, Houston, TX (US); Evan Lowe, Houston, TX (US); Abdolreza Gharesi, Houston, TX (US); Tim Hanberry, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 259 days.

(21) Appl. No.: 10/911,223

(22) Filed: Aug. 4, 2004

(65) Prior Publication Data

US 2005/0045337 A1 Mar. 3, 2005

Related U.S. Application Data

(63) Continuation-in-part of application No. 10/156,722, filed on May 28, 2002, now Pat. No. 6,837,313, which is a continuation-in-part of application No. 09/914,338, filed on Jan. 8, 2002, now Pat. No. 6,719,071.

(51) Int. Cl.
*E21B 43/24* (2006.01)

(52) U.S. Cl. ..... 166/369; 166/105; 175/424; 175/65

(58) Field of Classification Search ..... None
See application file for complete search history.

(56) References Cited

U.S. PATENT DOCUMENTS 1,892,217 A 12/1932 Moineau
2,050,458 A 8/1936 Ovestrud et al.

(Continued)

FOREIGN PATENT DOCUMENTS

GB 2162881 2/1986

(Continued)

OTHER PUBLICATIONS

Howerd et al, "Hydraulic Fracturing", Society of Petroleum Engineers of AIME, 1970, pp. 11-23.*

(Continued)

*Primary Examiner*—Frank Tsay
(74) *Attorney, Agent, or Firm*—Patterson & Sheridan, L.L.P.

(57) ABSTRACT

Methods for forming a portion of a wellbore are provided. The well is drilled from a first selected depth to a second selected depth to form a bore through a surrounding earth formation. A fluid heating apparatus is disposed within the bore on a working string. Fluid is then heated by moving the fluid through the fluid heating apparatus in the wellbore. The process of circulating fluid adjacent the earth formation serves to also heat the surrounding formation so as to increase the fracture gradient. The fluid heating process may be conducted during a drilling procedure. Alternatively, the fluid heating process may be conducted in connection with a liner hanging and cementing process. A fluid flow restrictor is provided along a run-in assembly that serves to warm the fluids as they are circulated. The warm fluids provide convective heat to the surrounding earth formation, thereby reducing the formation's fracture gradient.

46 Claims, 14 Drawing Sheets

U.S. PATENT DOCUMENTS

| | | | |
|---|---|---|---|
| 2,946,565 | A | 7/1960 | Williams |
| 3,802,916 | A | 4/1974 | Jackson |
| 3,964,547 | A | 6/1976 | Hujsak et al. |
| 4,008,856 | A | 2/1977 | Sears |
| 4,049,066 | A | 9/1977 | Richey |
| 4,063,602 | A | 12/1977 | Howell et al. |
| 4,078,610 | A | 3/1978 | Arnold |
| 4,085,803 | A | 4/1978 | Butler |
| 4,223,747 | A | 9/1980 | Marais |
| 4,291,772 | A | 9/1981 | Beynet |
| 4,430,892 | A | 2/1984 | Owings |
| 4,453,319 | A | 6/1984 | Morris |
| 4,534,426 | A | 8/1985 | Hooper |
| 4,545,442 | A | 10/1985 | Warner et al. |
| 4,583,603 | A | 4/1986 | Dorleans et al. |
| 4,630,691 | A | 12/1986 | Hooper |
| 4,640,352 | A | 2/1987 | Vanmeurs et al. |
| 4,640,359 | A | 2/1987 | Livesey et al. |
| 4,641,710 | A | 2/1987 | Klinger |
| 4,651,825 | A | 3/1987 | Wilson |
| 4,662,437 | A | 5/1987 | Renfro |
| 4,744,426 | A | 5/1988 | Reed |
| 4,813,495 | A | 3/1989 | Leach |
| 4,886,118 | A | 12/1989 | Van Meurs et al. |
| 4,942,929 | A | 7/1990 | Malachosky et al. |
| 5,025,862 | A | 6/1991 | Showalter |
| 5,027,721 | A | 7/1991 | Anderson |
| 5,098,481 | A | 3/1992 | Monlux |
| 5,111,756 | A | 5/1992 | Reed |
| 5,120,935 | A | 6/1992 | Nenniger |
| 5,247,994 | A | 9/1993 | Nenniger |
| 5,282,263 | A | 1/1994 | Nenniger |
| 5,339,898 | A | 8/1994 | Yu et al. |
| 5,339,899 | A | 8/1994 | Ravi et al. |
| 5,355,967 | A | 10/1994 | Mueller et al. |
| 5,570,749 | A | 11/1996 | Reed |
| 5,651,420 | A | 7/1997 | Tibbitts et al. |
| 5,720,356 | A | 2/1998 | Gardes |
| 6,006,837 | A | 12/1999 | Breit |
| 6,012,526 | A | 1/2000 | Jennings et al. |
| 6,065,550 | A | 5/2000 | Gardes |
| 6,119,779 | A | 9/2000 | Gipson et al. |
| 6,220,087 | B1 | 4/2001 | Hache et al. |
| 6,257,333 | B1 | 7/2001 | Mann et al. |
| 6,419,018 | B1 | 7/2002 | Naquin et al. |
| 6,527,062 | B2 | 3/2003 | Elkins et al. |
| 6,550,551 | B2 | 4/2003 | Brunnert et al. |
| 6,554,076 | B2 | 4/2003 | Guillory et al. |
| 6,564,874 | B2 | 5/2003 | Narvaez |
| 6,648,081 | B2 | 11/2003 | Fincher et al. |
| 6,662,884 | B2 | 12/2003 | Hemphill |
| 6,688,394 | B1 | 2/2004 | Ayling |
| 6,708,762 | B2 | 3/2004 | Haugen et al. |
| 6,719,071 | B1 | 4/2004 | Moyes |
| 6,732,804 | B2 | 5/2004 | Hosie et al. |
| 6,745,855 | B2 | 6/2004 | Gardes |
| 6,938,707 | B2 | 9/2005 | Schmidt et al. |
| 2004/0060737 | A1 | 4/2004 | deBoer |
| 2004/0069501 | A1 | 4/2004 | Haugen et al. |
| 2004/0112595 | A1 | 6/2004 | Bostick, III et al. |
| 2004/0118572 | A1 | 6/2004 | Whanger et al. |
| 2004/0118614 | A1 | 6/2004 | Galloway et al. |
| 2004/0124010 | A1 | 7/2004 | Galloway et al. |
| 2004/0129424 | A1 | 7/2004 | Hosie et al. |
| 2005/0045337 | A1 | 3/2005 | Bansal et al. |

FOREIGN PATENT DOCUMENTS

| | | |
|---|---|---|
| SU | 1276799 | 12/1986 |
| SU | 1474252 | 4/1989 |
| SU | 1543040 | 2/1990 |
| SU | 1585493 | 8/1990 |
| WO | WO 00/04269 | 1/2000 |
| WO | WO 00/08293 | 2/2000 |
| WO | WO 00/50731 | 8/2000 |
| WO | WO 02/14649 | 2/2002 |
| WO | WO 03/023182 | 3/2003 |
| WO | WO 03/025336 | 3/2003 |
| WO | WO 03/100208 | 12/2003 |
| WO | WO 2005/075790 | 8/2005 |

OTHER PUBLICATIONS

Bourgoyne Jr. et al, "Applied Drilling Engineering", Society of Petroleum Engineers, 1986, pp. 127-134.*

Forrest, et al., "Subsea Equipment for Deep Water Drilling Using Dual Gradient Mud System," SPE/IADC Drilling Conference, Amsterdam, The Netherlands, Feb. 27, 2001—Mar. 1, 2001, 8 pages.

PCT International Search Report, International Application No. PCT/US 03/16686, dated Aug. 21, 2003.

GB Search Report, Application No. GB607307.6, dated Jun. 8, 2006.

U.K. Search Report, Application No. GB0515975.1, dated Nov. 30, 2005.

Ling Tang and Pinya Luo, The Effect of the Thermal Stress on Wellbore Stability, SPE 39505, 1998 SPE India Oil and Gas Conference and Exhibition, New Delhi, India, Feb. 17-19, 1998, pp. 85-94.

Vincent Murray and J. L. Ldelovici, Safe Drilling of HP/HT Wells, The Role of the Thermal Regime in Loss and Gain Phenomenon, SPE/IADC 29428, SPE/IADC Drilling Conference in Amsterdam Feb. 28—Mar. 2, 1995, pp. 819-829.

Manuel E. Gonzalez, James B. Bloys, John E. Lofton, Gregory P. Pepin, Joseph H. Schmidt, Carey J. Naquin, Scot T. Ellis, and Patrick E. Laursen, Increasing Effective Fracture Gradients by Managing Wellbore Temperatures, IADC/SPE 87217, IADC/SPE Drilling Conference held in Dallas, Texas Mar. 2-4, 2004, pp. 1-14.

* cited by examiner

METHOD FOR COMPLETING A WELL USING INCREASED FLUID TEMPERATURE

CROSS-REFERENCE TO RELATED APPLICATIONS

This application is a continuation-in-part of U.S. patent application Ser. No. 10/156,722, filed May 28, 2002, now U.S. Pat. No. 6,837,313 which is incorporated by reference herein in its entirety. That application is entitled "Apparatus and Method to Reduce Fluid Pressure in a Wellbore."

That application, in turn, was a continuation-in-part of U.S. patent application Ser. No. 09/914,338, filed Jan. 8, 2002. That application has since matured into U.S. Pat. No. 6,719,071, and is likewise incorporated herein by reference.

BACKGROUND OF THE INVENTION

1. Field of the Invention

The present invention relates to the completion of a wellbore. More particularly, the invention relates to methods for completing a hydrocarbon wellbore that involve heating of circulating fluid to increase formation fracture pressure in the surrounding formation during drilling, cementing and completion operations.

2. Description of the Related Art

Hydrocarbon wells are formed by drilling a borehole in the earth, and then lining that borehole with steel casing in order to form a wellbore. After a section of earth has been drilled, a string of casing is lowered into the bore and temporarily hung therein from the surface of the well. Using apparatus known in the art, the casing is cemented into the wellbore by circulating cement into the annular area defined between the outer wall of the casing and the borehole.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing by the use of slips which utilize slip members and cones to wedgingly fix the new string of liner in the wellbore. The second casing string is then cemented in the well. This process is typically repeated with additional casing strings until the well has been drilled to total depth. In this manner, wells are typically formed with two or more strings of casing of an ever decreasing diameter.

It would be ideal to be able to drill a single, continuous bore into the earth that extends to a desired production zone without utilizing separate strings of casing. However, a variety of factors require that wellbores be formed in sequential stages. One such limiting factor is the need for weighted drilling fluid. Wells have historically been drilled by placing a column of weighted fluid, sometimes referred to as "drilling mud," in the drill string. The drilling mud serves to overcome formation pore pressures encountered as the wellbore is formed through the earth formations. In this respect, fluid pressure in a wellbore is intentionally maintained at a level above the pore pressure of formations surrounding the wellbore. Pore pressure refers to the natural pressure of fluid within a formation. The hydrostatic fluid pressure of the drilling fluid must be kept below the fracture pressure of the formation to prevent the wellbore fluid from entering the formation. Exceeding fracture pressure can result in fracturing of the formation and loss of expensive drilling fluid into the formation. More importantly, lost circulation creates a risk to personnel on the rig floor, as the rig is now subject to a "kick" caused by formation pore pressures.

The drilling mud is circulated through the drill bit and up an annular area between the drill string and surrounding casing or formation. The circulation of fluids in this manner not only aids in the control of wellbore pressures, but also serves to cool and lubricate the drill bit and to circulate cuttings back up to the surface. However, the circulation of fluids also forms a hydrostatic head and a friction head in the annular region that combine to form an "equivalent circulation density," or ECD. The use of drilling mud and the resulting ECD create an inherent limitation as to the depth at which any section of borehole may be drilled before it must be cased.

Conventionally, a section of wellbore is drilled to that depth where the combination of the hydrostatic pressure and friction head approaches the fracture pressure of the formation adjacent the bottom of the wellbore. At that point, casing is installed in the wellbore to isolate the formation from the increasing pressure before the wellbore can be drilled to a greater depth. In the past, the total well depth was relatively shallow and casing strings of a decreasing diameter were not a big concern. Presently, however, with extended reach drilling (ERD) wells, so many casing strings are necessary that the fluid path for hydrocarbons at a lower portion of the wellbore becomes very restricted. In other instances, deep wellbores are impossible due to the number of casing of strings necessary to avoid fracturing the formation and to complete the wellbore. FIG. 8 illustrates this point, which is based on a deepwater Gulf of Mexico example.

In FIG. 8, dotted line A shows pore pressure gradient, and line B shows fracture gradient of the formation, which is approximate to the pore pressure gradient but higher. Circulating pressure gradients of 15.2-ppg drilling fluid in a deepwater well is shown as line C. The circulation density line C is not parallel to the hydrostatic gradient of the fluid (line D). Safe drilling procedure requires circulating pressure gradient (line C) to lie between pore pressure and fracture pressure gradients (lines A and B). However, as shown in Graph 1, circulating pressure gradient of 15.2-ppg drilling fluid in this example extends above the fracture gradient curve at some point where fracturing of formation becomes inevitable. In order to avoid this problem, a casing must be set up to the depth where line C meets line B within predefined safety limit before proceeding for further drilling. For this reason, the drilling program for a GOM well called for as many as seven casing sizes, excluding the surface casing (Table 1).

TABLE 1

Planned casing program for GOM deepwater well.

| Casing size | Planned shoe depth | |
|---|---|---|
| (in.) | (TVD-ft) | (MD-ft) |
| 30 | 3,042 | 3,042 |
| 20 | 4,229 | 4,229 |
| 16 | 5,537 | 5,537 |
| 13-375 | 8,016 | 8,016 |
| 11-3/8 | 13,622 | 13,690 |

TABLE 1-continued

| Planned casing program for GOM deepwater well. | | |
|---|---|---|
| Casing size | Planned shoe depth | |
| (in.) | (TVD-ft) | (MD-ft) |
| 9-5/8 | 17,696 | 18,171 |
| 7 | 24,319 | 25,145 |
| 5 | 25,772 | 26,750 |

Attempts have been made to reduce the pressure of fluid in a circulating wellbore. However art approaches have been directed primarily towards reducing pressure at the bit to facilitate the movement of cuttings to the surface. In a prior art patent, a redirection apparatus is shown which vents fluid from an interior of a tubular to an exterior thereof. While this device stirs up and agitates wellbore fluid, it does not provide any meaningful lift to the fluid in order to reduce the pressure of fluid there below.

A similar issue may be confronted during a cementing operation. In this respect, the act of sequentially circulating various fluids through a liner and back up the annulus necessarily creates radial pressures on the surrounding borehole. The presence of a full annulus additionally creates additional hydrostatic pressure. Moreover, the circulation of such fluids creates a "friction head," as described above. Various fluids may be circulated during a cementing operation, including mud, water and the cement itself. These factors also may limit the length of liner that can be cemented in one completion stage.

There is a need, therefore, for a method of completing a wellbore that reduces the number of casing strings (liners) needed. In addition, there is a need for a method of completing a wellbore that causes the formation to tolerate a higher equivalent circulation density (ECD) of the drilling fluid. Further, there is a need for a method of completing a wellbore that utilizes a fluid heating apparatus to heat fluids as they are circulated during drilling and, in addition, which adds energy to fluids in the annular region. There is yet a further need for a method to reduce or to prevent differential sticking of a work string in a wellbore as a result of fluid loss into the wellbore. Still further, there is a need for a tool that may be employed that inhibits formation fracturing or fluid loss during a cementing operation. Some of these objects and others are met by various embodiments of the methods of the present invention.

SUMMARY OF THE INVENTIONS

The present invention generally provides methods for forming a portion of a wellbore. In one embodiment, the method includes the steps of drilling a well from a first selected depth to a second selected depth to form a bore through a surrounding earth formation, disposing a fluid heating apparatus in the bore, heating fluid by moving the fluid through the fluid heating apparatus, and heating the surrounding earth formation by circulating the heated fluid adjacent the earth formation so as to increase the fracture resistance of the formation. Preferably, the fluid heating apparatus is a fluid flow restrictor.

In one aspect, the method further includes the steps of running a liner into the bore; and cementing the liner in place in the wellbore after the surrounding formation has been heated along a selected length. The liner is preferably run into the bore on a liner hanger assembly, and a fluid heating apparatus in the form of a fluid flow restrictor is disposed in a run-in assembly for the liner hanger assembly.

A novel run-in assembly for a liner hanger operation is provided herein. In one aspect, the run-in assembly includes a running tool releasably connectible to the liner hanger assembly, a retrievable seal mandrel, and an elongated inner pipe. The inner pipe is configured to reside within the liner string, thereby forming an annular area for the circulation of warmed fluids. A fluid heating apparatus is provided with the running tool assembly. In one aspect, the fluid heating apparatus is a restricted diameter portion of the inner pipe. The elongated inner pipe may comprise a pipe section within the seal mandrel, a cross-over port connected to the pipe at a lower end, and a stinger portion connected below the crossover port joint. A circulating bypass apparatus may be provided along the elongated pipe to permit fluids to selectively fluid by the seal mandrel. have a fluid fan outer stinger connected below the retrievable seal mandrel, an inner pipe within the outer stinger, and a circulating bypass sleeve or valve. In one aspect, the circulating bypass apparatus includes an upper port and a lower pipe opening, and is movable relative to the retrievable seal mandrel to permit the upper and lower ports to straddle the retrievable seal mandrel and to permit circulated fluids to bypass the retrievable seal mandrel during fluid circulation.

In another embodiment, a method for drilling a wellbore is provided. The steps include drilling a well to a first selected depth to form a bore through earth formations; fixing a string of casing in the bore to form a wellbore; determining formation fracture pressure of the earth formation at the bottom of the wellbore; calculating a density of drilling fluid to offset formation pore pressure at the bottom of the wellbore while drilling without exceeding the formation fracture pressure; and then increasing the calculated density in anticipation of increased formation fracture pressure when the drilling fluid is heated. The calculated density of drilling fluid may further be adjusted upwardly to take into account energy added to the fluid in the annular region to reduce the hydrostatic head. The method may additionally include the further steps of resuming drilling of the well to a second selected depth; circulating the drilling fluid at the increased density while resuming the drilling of the well; heating the drilling fluid while the drilling fluid is being circulated through the working string; and adding energy to the drilling fluid traveling in the annulus to reduce hydrostatic head in the wellbore.

Preferably, the step of resuming drilling of the well defines the steps running a working string into the wellbore, the working string having a bore therein, and a drill bit disposed at the end of the working string; and rotating the drill bit. In addition, the step of heating the drilling fluid and the step of adding energy to the drilling fluid are preferably each performed by actuating a downhole annular pump disposed along the working string.

In one arrangement, the downhole annular pump is mechanically coupled to a downhole turbine within the bore of the working string. The turbine converts the hydraulic energy into the mechanical energy that drives the annular pump. In addition, the turbine acts as a fluid flow restrictor that converts hydraulic energy into thermal energy. The thermal energy convectively transmits heat through the working string, through fluid in the annular region, and into the wellbore.

In another embodiment, the method for completing a wellbore includes the steps of forming a wellbore to a selected depth; disposing a fluid heating apparatus onto a working string, the working string having a bore therein;

running the working string into the wellbore; circulating fluid down into the wellbore through the bore of the working string and through the fluid heating apparatus; circulating fluid back up the wellbore through an annulus formed between the working string and the surrounding wellbore. The fluid heating apparatus is preferably a fluid flow restrictor that heats the fluid through friction; however, other heating devices such as a dedicated heating coil may be employed. In the former arrangement, the fluid heating apparatus itself adds energy to the circulated fluids in the annulus via a downhole annular pump so as to reduce the hydrostatic head acting in the annular region of the wellbore during drilling. Preferably, the annular pump is actuated by fluid flowing through the flow restrictor along the working string. However, energy may alternatively be added by a separate tool, such as a downhole motor. The downhole motor may either be connected to the downhole annular pump to assist in driving the pump, or may operate independently from the downhole annular pump.

The circulating fluid may be drilling fluid (such as, but not limited to, weighted mud), cement, or other fluid.

In another embodiment, the method for completing a wellbore includes the steps of running a working string into a bore in the earth, the working string having a bore therein, and a drill bit disposed proximate an end of the working string; rotating the working string to drill through an earth formation; circulating a drilling fluid while rotating the drill bit, the fluid being circulated in a first direction through the bore of the working string and the drill bit, and in a second direction through an annular region formed between the working string and the surrounding earth formation; heating the drilling fluid through a fluid flow restrictor while the drilling fluid is being circulated through the working string; and adding energy to the drilling fluid traveling in the annulus to reduce the hydrostatic head in the wellbore. Preferably, the steps of heating the drilling fluid and adding energy to the drilling fluid are again each performed by circulating fluid through a downhole turbine which drives an annular pump disposed along the working string.

In one aspect of the inventions, an ECD (equivalent circulation density) reduction tool provides a means for drilling extended reach deep (ERD) wells with heavyweight drilling fluids by reducing the effect of the hydrostatic head on bottomhole pressure so that circulating density of the fluid is close to its actual density. With an ECD reduction tool located in the well, the hydrostatic head is substantially reduced, which in turn reduces the risk of fracturing a formation. At the same time, the ECD reduction tool increases the temperature of the fluid before it contacts the surrounding earth formation at the bottom of the wellbore. The increased temperature serves to increase formation fracture resistance. This, in turn, allows the formation to tolerate a greater ECD so that more earth can be penetrated during drilling between casing stages. The number of casing sizes required to complete the well is thereby reduced. This is particularly helpful in those circumstances where casing shoe depth is limited by a narrow margin between pore pressure and fracture pressure of the formation.

In another aspect of the inventions, an ECD reduction tool is used to overcome differential sticking. Differential sticking of the working string in a wellbore is a problem sometimes associated with deep wells. If wellbore fluid enters an adjacent formation, the work string can be pulled in the direction of the exiting fluid due to a pressure differential between pore and wellbore pressure, and become stuck.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

In FIG. 5A, the run-in assembly is in its run-in position relative to the liner hanger assembly. It is understood that the run-in assembly is disposed along a bore in the liner hanger assembly.

In FIG. 5B, the run-in assembly is in position to set the liner hanger and connected liner in the wellbore. A ball has been dropped through the liner-hanger assembly to allow a hydraulically set liner hanger to be actuated.

In FIG. 5C, the run-in assembly is in position for the circulation of fluid through the outer stinger and the inner pipe. A bypass sleeve in the run-in assembly has been raised relative to the liner hanger assembly. Upper ports and lower ports in bypass sleeve straddle a retrievable seal mandrel in the run-in assembly.

In FIG. 5D, the run-in assembly is in position for the circulation of cement through the inner pipe and the cement shoe, and then back up the annular region between the liner and the surrounding earth formation. A wiper plug is pumped into the working string and through the run-in assembly after a desired volume of cement has been injected into the wellbore.

In FIG. 5E, the run-in assembly is raised, and is put in position to set the packer along the liner hanger assembly.

FIG. 5F shows the run-in assembly being pulled from the liner hanger assembly and the wellbore.

In FIG. 6A, the liner hanger assembly is in its run-in position along with the run-in assembly. It is again understood that the run-in assembly is disposed along a bore in the liner hanger assembly.

In FIG. 6B, the liner hanger assembly is in position for the liner hanger and connected liner to be set in the wellbore. A ball has been dropped through the liner hanger assembly to allow the hydraulically set liner hanger to be actuated.

In FIG. 6C, the liner hanger assembly is in position for the circulation of fluid through the outer stinger and the inner pipe of the run-in assembly.

In FIG. 6D, the liner hanger assembly continues to receive the run-in assembly. A wiper plug is pumped into the working string and through the run-in assembly after a desired volume of cement has been injected into the wellbore.

In FIG. 6E, the packer of the liner hanger assembly is being set through mechanical force applied by the run-in assembly.

FIG. 6F shows that the liner hanger assembly and liner are set in the wellbore.

DETAILED DESCRIPTION OF THE PREFERRED EMBODIMENT

Figure 1:
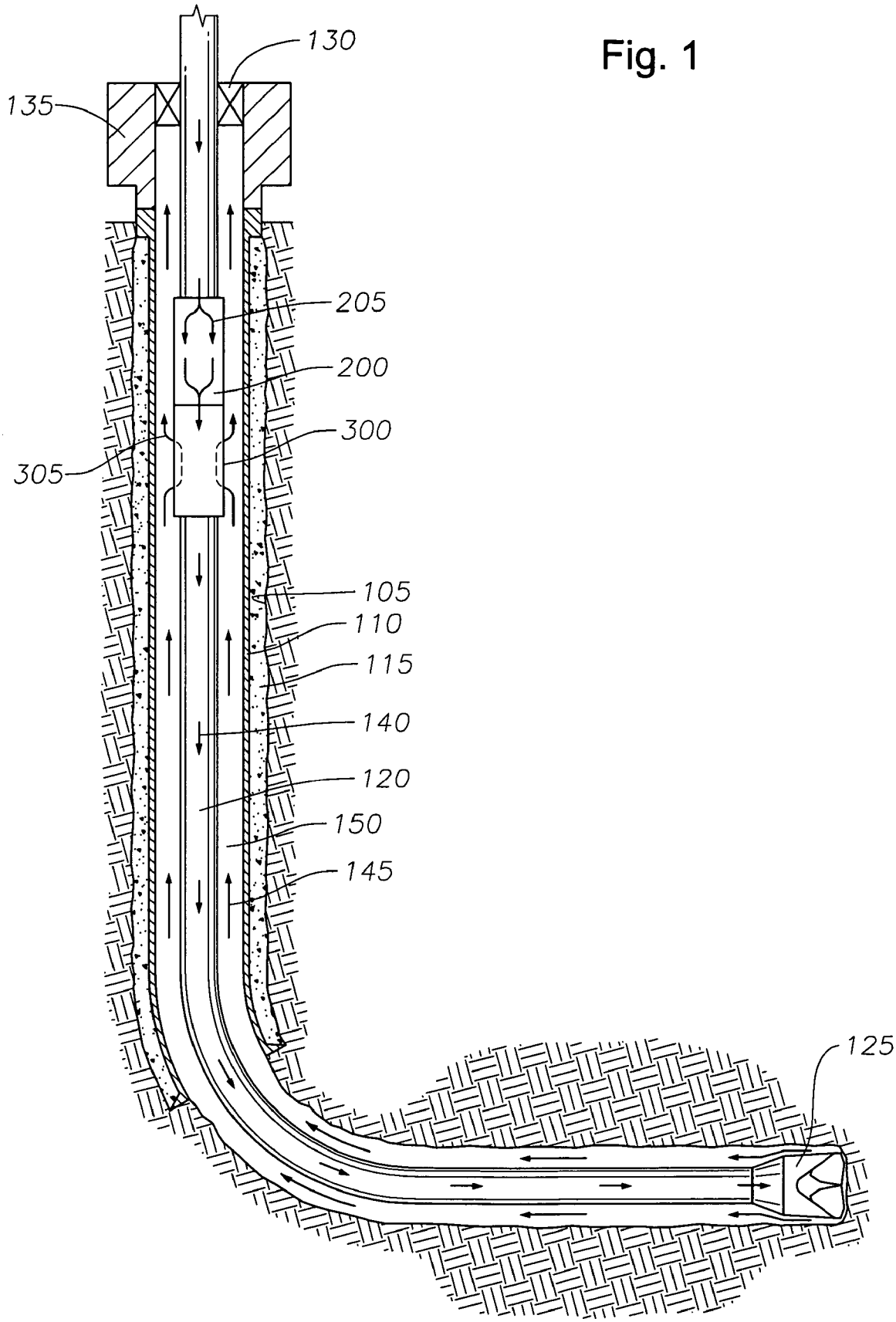
FIG. 1 is a section view of a wellbore having a work string coaxially disposed therein and a fluid heating apparatus disposed along the work string.

The present invention relates to various methods for completing a wellbore. The various methods may first be understood in the context of the exemplary wellbore 105 found in FIG. 1. The wellbore 105 of FIG. 1 comprises a central portion and a horizontal portion, though the present methods may be employed in a wellbore of any configuration. The central wellbore is lined with casing 110. An annular area between the casing 110 and the surrounding earth formation 50 is filled with cement 115 to strengthen and isolate the central wellbore 105 from the earth.

At a lower end of the central wellbore, the casing 110 terminates. The horizontal portion of the wellbore 105 extends below the central portion. The horizontal bore opens into an "open hole" portion. This means that the lower portion of the illustrative wellbore 105 is uncased.

A working string 120 is placed within the wellbore 105. The working string 120 resides generally coaxially in the wellbore 105, and is made up of a plurality of tubulars threaded together in series. A drill bit 125 is disposed at a lower end of the working string 120. The bit 125 rotates at the end of the string 120 to form the borehole. Rotation may be provided at the surface of the well by turning a Kelly using a motor on the rig platform (not shown), or by a mud motor (not shown) located in the string 120 proximate the drill bit 125.

In FIG. 1, an annular area 150 is formed around the working string 120 and within the casing 110/open hole formation. An upper portion of the working string 120 is optionally sealed with a packer 130 placed between the working string 120 and a wellhead 135.

Drilling fluid, or "mud," is circulated in the wellbore 105. First, drilling fluid is circulated down the working string 120, and exits the drill bit 125. The fluid typically provides lubrication for the rotating bit, as well as a means for transporting cuttings to the surface of the well 105. In addition, and as stated herein, the drilling fluid provides a pressure against the sides of the wellbore 105 to keep the well in control and prevent wellbore fluids from entering the wellbore 105 before the well is completed. FIG. 1 provides arrows 140 showing the initial direction for circulating the drilling fluid into the wellbore 105. Upon exiting the drill bit 105, fluids are circulated back up the annular region 150. FIG. 1 provides arrows 145 to show a return path of the fluid from the bottom of the wellbore 105. From there, fluids are pumped to the surface of the well.

It can be seen from FIG. 1 that the wellbore 105 was drilled to a first designated depth to form a bore through the surrounding earth formations 50. Thereafter, the string of casing 110 was hung and cemented into place to isolate the formation from the wellbore 105. At that point, the operator takes steps to determine the formation fracture pressure of the earth formation at the bottom of the wellbore 105. Typically, this is done through a test called a "leak-off" test. The operator injects a fluid (such as salt water or light mud) into a working string, and then progressively applies pressure to the wellbore 105 until fluid begins to "leak" into a portion of the formation near the bottom of the wellbore. This provides the operator with the pressure value for formation fracture pressure. This, in turn, advises the operator of an ECD value that should not be exceeded during further drilling.

The operator is informed with the depth of the wellbore which provides a hydrostatic pressure on the bottom formation when the wellbore 105 is filled with drilling fluid. The operator is able to factor frictional forces induced by fluid circulation up the annular region 150 into this value. These frictional forces are, again, due to the "friction head". With this data, the operator is able to calculate an appropriate weighting of drilling fluid to offset formation pore pressure at the bottom of the wellbore without exceeding the formation fracture pressure. The operator may then resume drilling.

It has been observed that the temperature of circulating fluid has a thermal effect on wellbore stresses. More specifically, an increased temperature of circulating fluids downhole impacts fracture pressure along the exposed formation. Increasing the temperature of circulating fluid can increase the fracture pressure of the formation. This makes it possible to drill deeper wellbore portions and advance casing shoe depth, or to use higher density fluid with less risk of fracturing the formation when the drilling fluid is heated. Greater resistance of formation to fracturing also permits raising the column of cement slurry in the annular region 150 between the casing and wellbore.

Once this adjusted fluid weight is determined, the operator resumes drilling of the well to a second selected depth. During this time, fluid is circulated in the working string 120 and through the drill bit 125 at the appropriate weight in accordance with arrows 140. In accordance with one aspect of the present invention, the drilling fluid may be heated by flowing it through a fluid heating apparatus. The fluid heating apparatus is any tool that converts hydraulic energy to thermal energy. An example is a fluid flow restrictor disposed along the working string. As noted, the fluid heating apparatus serves to increase the fracture resistance of the formation. In addition, energy may be added to the drilling fluid traveling in the annulus 150 via arrows 145 to further reduce the hydrostatic head of circulated fluid in the wellbore 105. This allows the operator to drill a greater length of hole without exceeding the formation fracture resistance.

Preferably, the step of resuming drilling of the well defines the steps running a working string 120 into the wellbore 105. The working string 120 has a bore therein for receiving the circulated fluids. In addition, the drill bit 125 is rotated in order to "make hole." Preferably, the step of heating the drilling fluid and the step of adding energy to the drilling fluid are preferably each performed by actuating a downhole device disposed along the working string. An example of such a device is a downhole annular pump driven by a turbine in the bore of the working string 120.

Disposed in the working string 120 and shown schematically in FIG. 1 is a turbine 200 and a pump 300. The purpose of the turbine 200 is to convert hydraulic energy into mechanical energy and heat. Preferably, the turbine 200 is actuated by pumping fluids therethrough. Thus, as shown with arrows 205, and as will be discussed in detail below, fluid traveling down the work string 120 travels through the turbine 200 and causes a shaft (not shown) therein to rotate. The turbine 200 therefore serves as a hydraulically actuated motor. The travel path for fluid through the turbine 200 restricts the flow of fluid through the working string 120, thereby increasing the temperature of the circulating fluid before it contacts the surrounding earth formation 50.

The shaft of the turbine 200 is mechanically connected to and actuates a shaft (not shown) in the pump 300. Fluid flowing upwards in the annulus 150 is directed into an area of the pump (arrows 305) where it flows between a rotating rotor and a stationary stator. Thus, the purpose of the pump 300 is to act upon fluid circulating back up the wellbore 105 in the annulus 150. This acts to provide energy or "lift" to the fluid. This added energy reduces the hydrostatic pressure of the fluid in the wellbore 105 below the pump 300 as energy is added to the upwardly moving fluid by the pump 300.

Turbines are known in the art and utilize a flow of fluid to produce a rotational movement. There are other devices that utilize a flow to create rotational movement, such as progressive cavity motors. Progressive cavity motors use concepts and mechanisms taught by Moineau in U.S. Pat. No. 1,892,217, which is incorporated by reference herein in its entirety. A typical motor of this type has two helical gear members wherein an inner gear member rotates within an outer gear member. Typically, the outer gear member has one helical thread more than the inner gear member. During the rotation of the inner gear member, fluid is moved in the direction of travel of the threads. In another variation of motor, fluid entering the motor is directed via a jet onto bucket-shaped members formed on a rotor. Such a motor is described in International Patent Application No. PCT/GB99/02450 and that publication is incorporated herein in its entirety. Regardless of the turbine or motor design, the purpose is to provide rotational force to the pump so that the pump might affect fluid traveling upwards in the annulus 150.

Figure 2A:
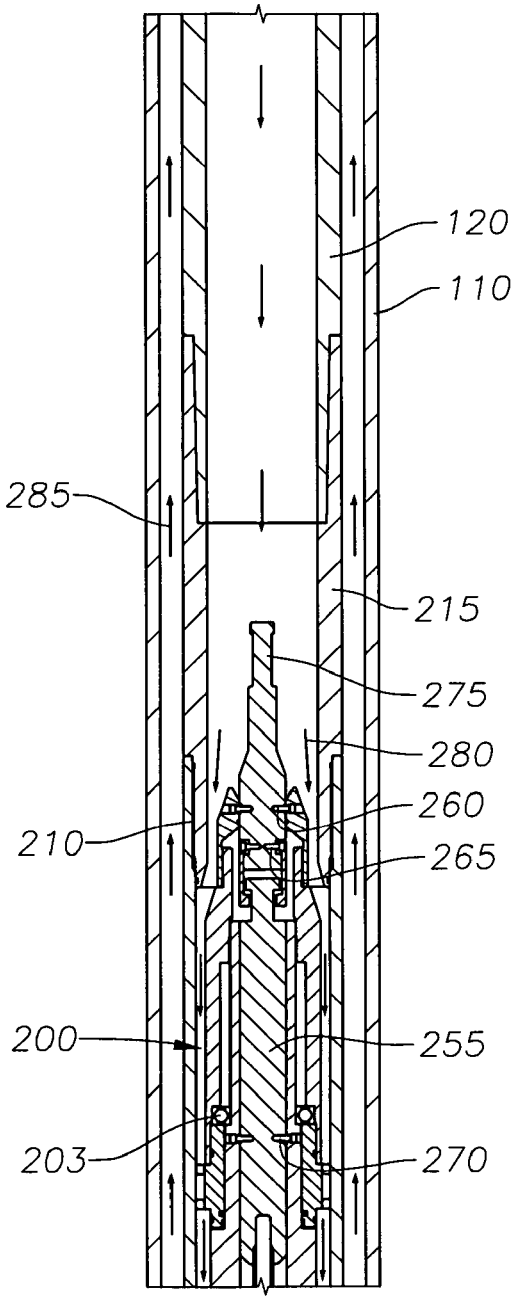
FIG. 2A is a section view of the wellbore showing a plug assembly disposed in an upper portion of the turbine.
Figure 2B:
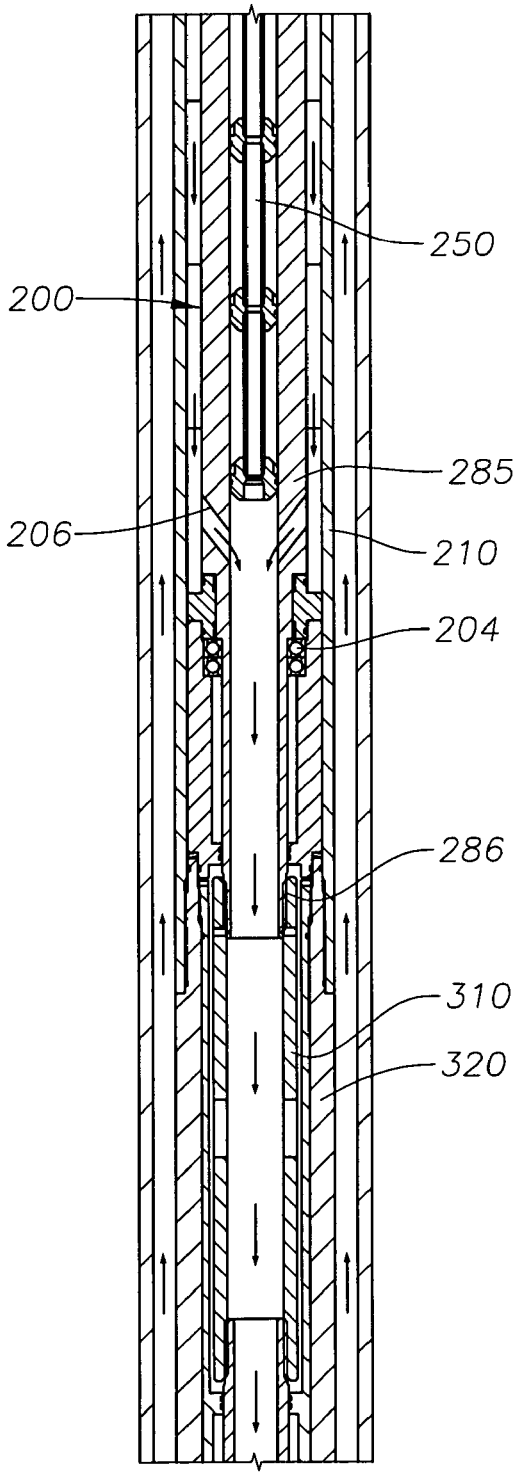
FIG. 2B is a section view schematically showing the turbine.

FIG. 2A is a section view of the upper portion of one embodiment of the turbine 200. FIG. 2B is a section view of the lower portion thereof. Visible in FIG. 2A is the wellbore casing 110 and the work string 120 terminating into an upper portion of a housing 210 of the turbine 200. In the embodiment shown, an intermediate collar 215 joins the work string 120 to the motor housing 210. Centrally disposed in the housing 210 is a plug assembly, or flow diverter, that is removable in case access is needed to a central bore of the turbine housing 210. A plug 255 is anchored in the housing 210 with two or more shear pins 260, 265, 270. A fish-neck shape 275 formed at an upper end of the plug 255 provides a means of remotely grasping the plug 255 and pulling it upwards with enough force to cause the shear pins to fail. When the plug 255 is in place, an annulus is formed between the plug 255 and the inside of the housing 210. Fluid from the working string 120 travels in the annulus. Arrows 280 show the downward direction of the fluid into the motor 200, while other arrows 285 show the return fluid in the wellbore annulus 150 between the casing 110 and the turbine 200.

The turbine of FIG. 2A is intended to be of the type disclosed in the aforementioned international application PCT/GB99/02450 with the fluid directed inwards with nozzles to contact bucket-shaped members and cause the rotor portion of shaft to turn.

A shaft 285 of the turbine 200 is supported in the housing 210 by two sets of bearings 203, 204 that keep the shaft 285 centralized in the housing 210 and reduce friction between the spinning shaft 285 and the housing 210 therearound. At a location near the lower bearings 204, the fluid is directed inwards to the central bore of the shaft 285 with inwardly directed channels 206 radially spaced around the shaft 285. At a lower end, the shaft 285 of the turbine 200 is mechanically connected to a pump shaft 310 coaxially located therebelow. The connection in one embodiment is a hexagonal, spline-like connection 286 rotationally fixing the shafts 285, 310, but permitting some axial movement within the connection. The motor housing 210 is preferably provided with female threads at a lower end, and threadingly attached to an upper end of a pump housing 320 having male threads formed thereupon.

While the turbine 200 in the embodiment shown is a separate component with a housing threaded to the working string 120, it will be understood that by miniaturizing the parts of the turbine 200, it could be fully disposed within the working string 120 and removable and interchangeable without pulling the entire working string 120 from the wellbore 105. For example, in one embodiment, the motor 200 is run separately into the working string 120 on wire line where it latches at a predetermined location into a preformed seat in the tubular working string 120 and into contact with a pump disposed therebelow in the working string 120.

Figure 2C:
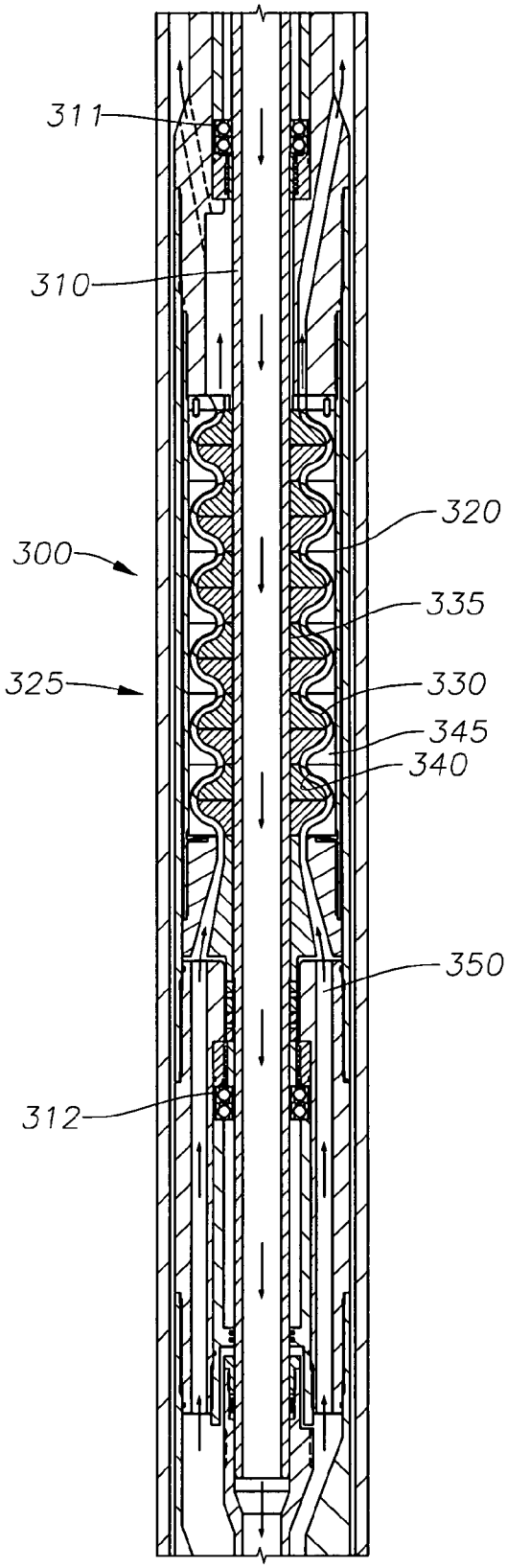
FIG. 2C is a section view of the wellbore and pump of the present invention.
Figure 2D:
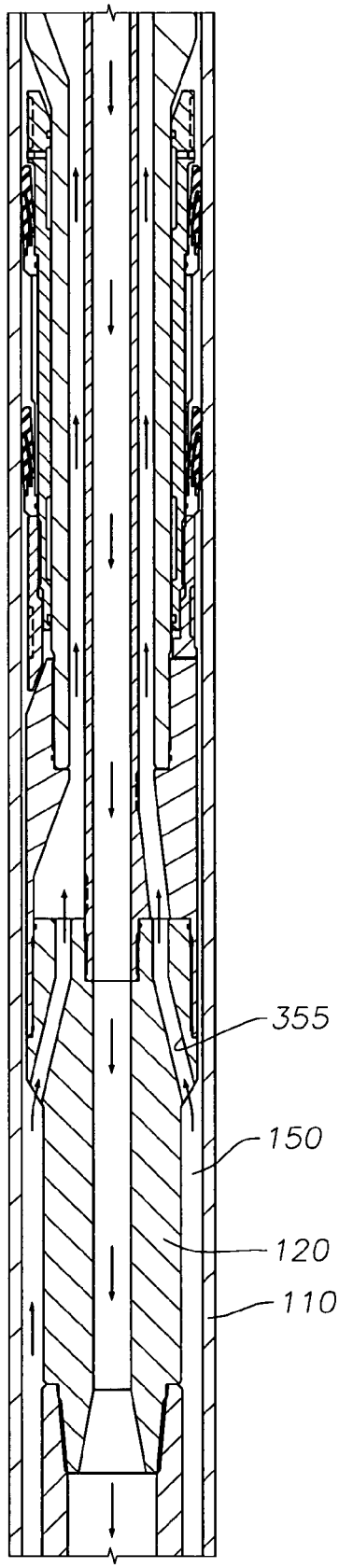
FIG. 2D is a section view of the wellbore showing an area of the wellbore below the pump.

FIG. 2C is a section view of the pump 300, while FIG. 2D provides a section view of a portion of the wellbore 105 below the pump 300. FIG. 2C shows the pump shaft 310 and two bearings 311, 312 mounted at upper and lower ends thereof to center the pump shaft 310 within the pump housing 320. Fluid travels to the pump 300 from the drill bit (seen at 125 in FIG. 1) at the lower end of the working string 120. Visible also in FIG. 2C is an impeller section 325 of the pump 300. The impeller section 325 includes outwardly formed undulations 330 formed on an outer surface of a rotor portion 335 of the pump shaft 310, and matching outwardly formed undulations 340 on the interior of a stator portion 345 of the pump housing 320 therearound.

Below the impeller section 325, an annular path 350 is formed within the pump 300 for fluid traveling upwards towards the surface of the well. Referring to both FIGS. 2C and 2D, the return fluid travels into the pump 300 from the annulus 150 formed between the casing 110 and the working string 120. As the fluid approaches the pump 300, it is directed inwards through outwardly formed channels 355 where it travels upwards and through the space formed between the rotor and stator (FIG. 2C). Energy or "upward lift" is added to the fluid in order to reduce pressure in the wellbore therebelow. As shown in the figure, return fluid traveling through the pump 300 travels outwards and then inwards in the fluid path along the undulating formations of the rotor or stator, also added thermal energy to the fluid.

Figure 3:
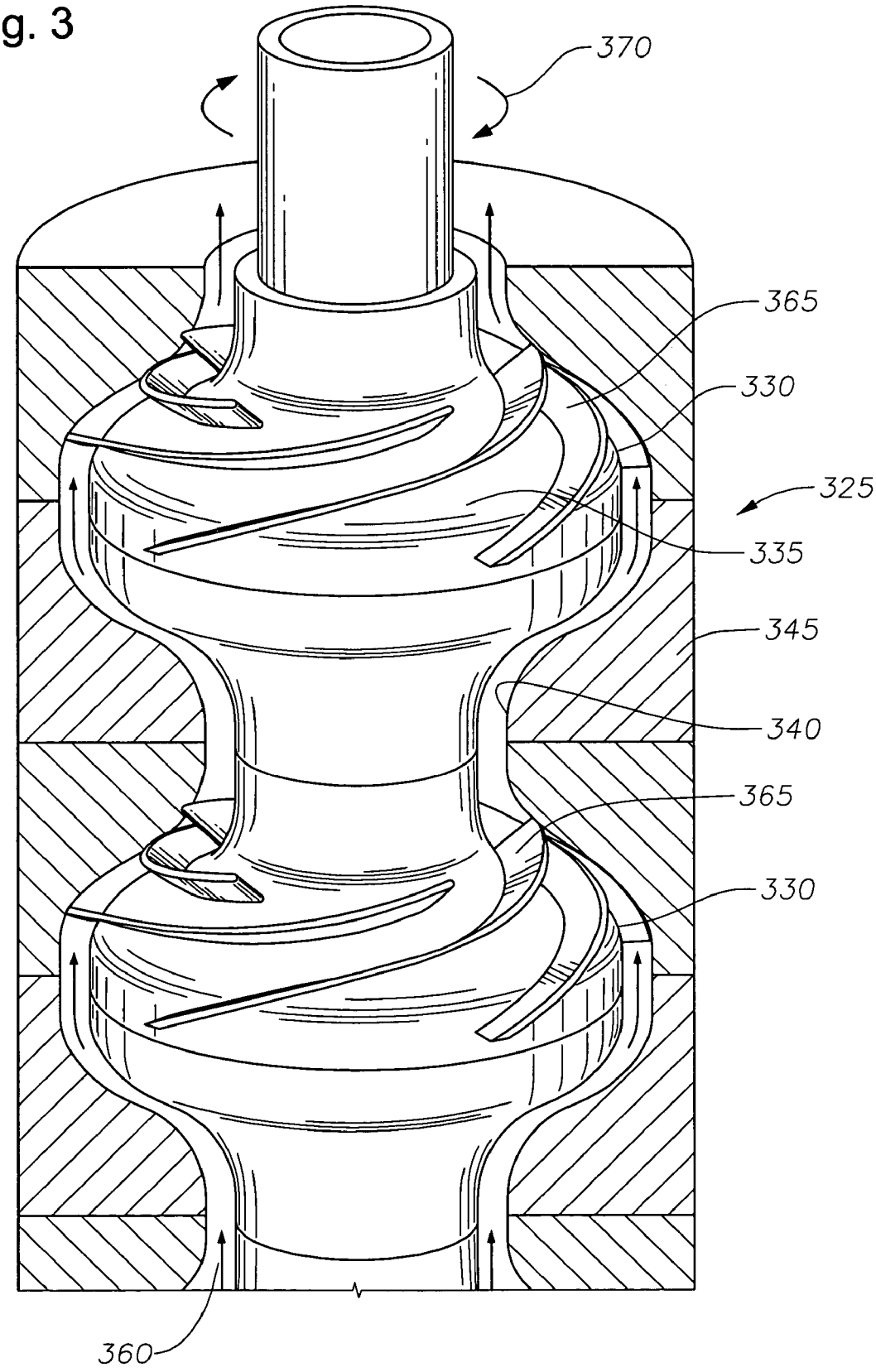
FIG. 3 is a partial perspective view of the impeller portion of the pump.

FIG. 3 is a partial perspective view of a portion of the impeller section 325 of the pump 300. In a preferred embodiment, the pump 300 is a centrifugal pump. Fluid, shown by arrow 360, travels outwards and then inwards along the outwardly extending undulations 330 of the pump rotor 235 and the inwardly formed undulations 340 of the stator 345. In order to add energy to the fluid, the upward facing portion of each undulation 330 includes helical blades 365 formed thereupon. As the rotor 235 rotates in a clockwise direction as shown by arrows 370, the fluid is acted upon by a set of blades 365 as it travels inwards towards the central portion of the rotor 335. Thereafter, the fluid travels along the outwardly facing portion of the undulations 330 to be acted upon by the next set of blades 365 as it travels inward.

A casing program for the GOM well called for seven casing sizes, excluding the surface casing, starting with 20" OD casing and ending with 5" OD casing (Table 1). The 9⅝" OD casing shoe was set at 18,171-ft MD with 15.7-ppg leakoff test. Friction head at 9⅝" casing shoe was calculated as 326-psi, which gave an ECD of 15.55-ppg. Thus with 15.5-ppg ECD the margin for kickoff was 0.15-ppg.

From the above information, formation fracture pressure ($P_{f9.625}$), hydrostatic head of 15.2-ppg drilling fluid ($P_{h9.625}$) and circulating fluid pressure ($P_{ECD9.625}$) at 9⅝" casing shoe can be calculated as:

$$P_{f9.625}=0.052\times15.7\times17{,}696=14{,}447 \text{ psi}$$

$$P_{h9.625}=0.052\times15.2\times17{,}696=13{,}987 \text{ psi}$$

$$P_{ECD9.625}=0.052\times15.55\times17{,}696=14{,}309 \text{ psi.}$$

Average friction head per foot of well depth=326/17,696=$1.842\times10^{-2}$ psi/ft.

Theoretically the ECD reduction tool located in the drill string above the 9⅝" casing shoe could provide up to 326-psi pressure boost in the annulus to overcome the effect of hydrostatic head on wellbore pressure. However, for an ECD motor and pump to operate effectively, the drilling fluid flow rate should reach 40 to 50 percent of full circulation rate before a positive effect on wellbore pressure is realized. Hence, the efficiency of the ECD reduction tool is assumed to be 50%, which means that the circulating pressure at 9⅝" casing shoe with an ECD reduction tool in the drill string would be 14,146-psi (14,309−326/2).

$$\text{Actual } ECD=14{,}146/(0.052\times17{,}696)=15.38 \text{ ppg.}$$

The safety margin for formation fracturing has improved to 0.32-ppg from 0.15-ppg. Assuming the fracture pressure follows the same gradient (15.7-ppg) all the way up to 28,000-ft TVD, the fracture pressure at TVD is:

$$P_{fTVD}=0.052\times15.7\times28{,}000=22{,}859\text{-psi.}$$

Figure 9:
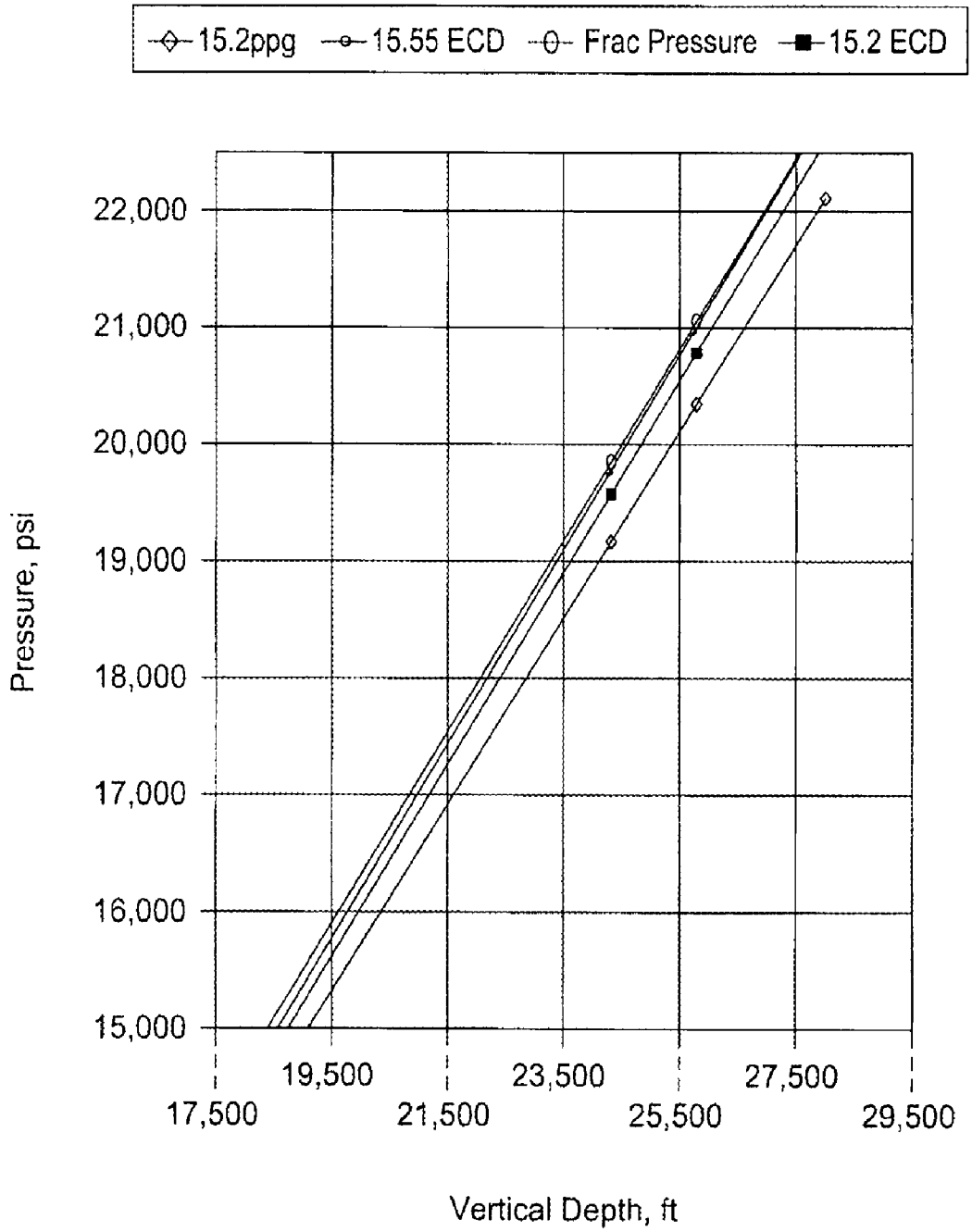

Circulating pressure at 28,000 TVD=$0.052\times15.38\times28{,}000+1.842\times10^{-2}\times(28000-17696)=22{,}582$ psi The above calculations are summarized in Table 2 and FIG.9.

TABLE 2

Summary of pressure calculations at different depths in the well.

| Vertical depth, ft | Frac Pressure | Hydrostatic head of 15.2-ppg drilling fluid | Wellbore Pressure Without ECD tool | Wellbore pressure With ECD tool | Casing Size, in |
|---|---|---|---|---|---|
| 17,696 | 14,447 | 13,987 | 14,309 | 14,153 | 9-5/8 |
| 24,319 | 19,854 | 19,222 | 19,786 | 19.571 | 7 |
| 25,772 | 21,040 | 20,370 | 20,988 | 20,760 | 7 |
| 28,000 | 22,859 | 22,131 | 22,831 | 22,583 | 7 |

This analysis shows that the entire segment of the well below 9⅝" casing could be drilled with 15.2-ppg drilling fluid if there was an ECD reduction tool in the drill string. A 7" casing could be set at TVD eliminating the need for 5" casing. Notice from FIG. 9 how 15.55-ppg curve without an ECD reduction tool (blue) runs into frac pressure curve (red). In comparison 15.38-ppg curve with an ECD reduction tool in the drill string (green) stays below the frac pressure curve and above the hydrostatic head curve (black). These numbers are even more impressive, though not set forth, when fluid is heated during circulation.

FIG. 9 Effect of ECD reduction tool on safety margin for formation fracturing with drilling fluid in circulating ERD well.

Figure 4:
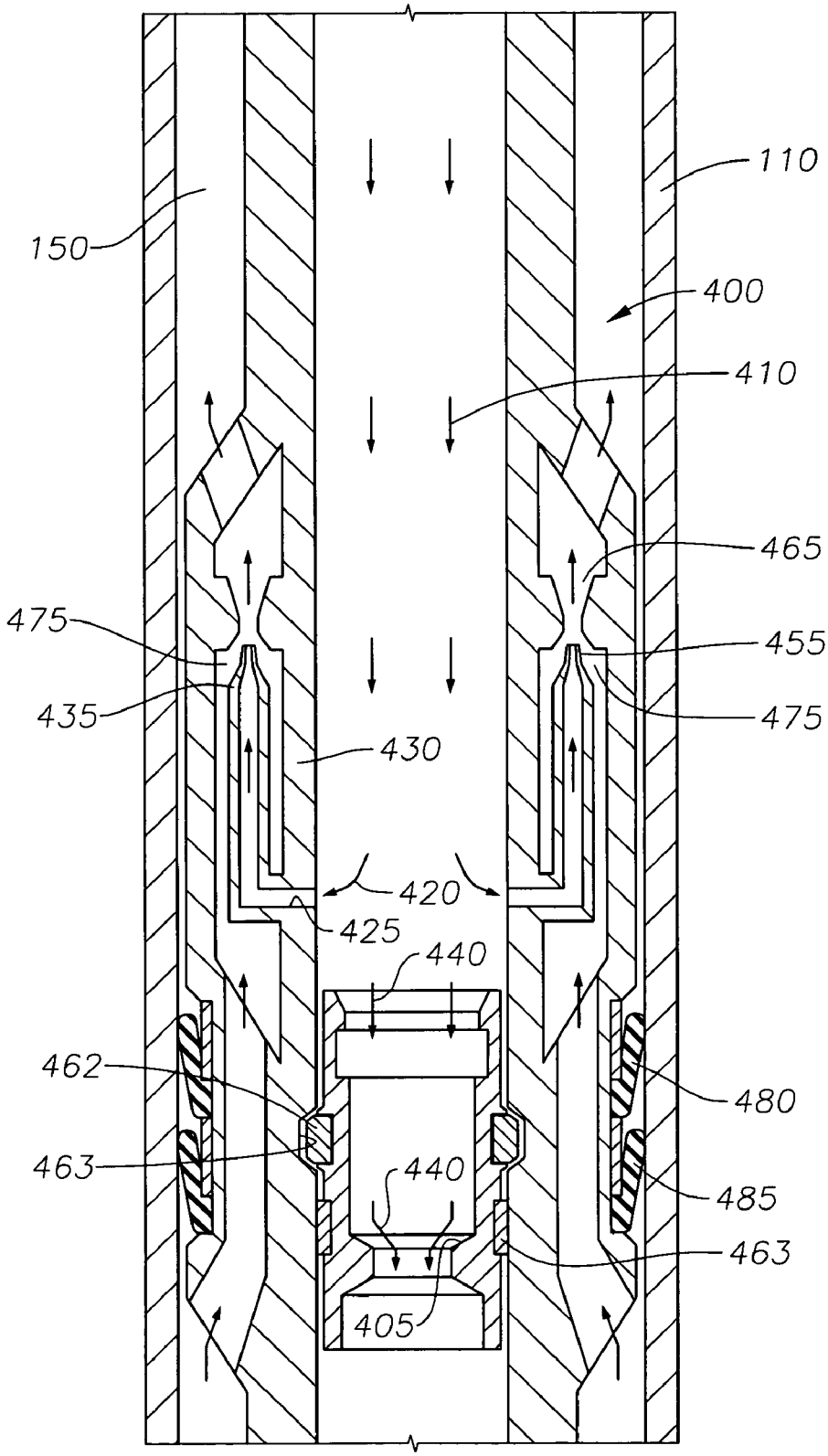
FIG. 4 is a section view of a wellbore showing an alternative embodiment of the invention. In this embodiment, a jet pump is used.

FIG. 4 is a section view of a wellbore showing an alternative embodiment of the invention. A jet device 400 is shown residing with a string of casing 110. The jet device 400 utilizes nozzles 435 to create a low-pressure area. Thus, the device 400 acts as a "venturi" pump. The device 400 serves to urge fluid in the wellbore annulus (150 of FIG. 1) upwards, thereby adding energy to the fluid.

The device 400 of FIG. 4 includes a restriction 405 in a bore thereof that serves to cause a backpressure of fluid traveling downwards in the wellbore (arrows 410). The backpressure causes a portion of the fluid (arrows 420) to travel through openings 425 in a wall 430 of the device 400, and to be directed through nozzles 435 leading into annulus 150. The remainder of the fluid continues downwards (arrows 440). The nozzle 435 includes a restriction 455, a throat 460, and a diffuser portion 465. The geometry and design of the nozzles 435 create a low-pressure area 475 near the end of each nozzle 435. Because of fluid communication between the low-pressure area 475 and the wellbore annulus 150, fluid below the nozzles 435 is urged upwards due to the pressure differential.

In the embodiment of FIG. 4, the annular area 150 between the jet device 400 and the wellbore casing 110 is sealed with a pair of packers 480, 485 to urge the fluid into the jet device 400. The restriction portion 405 of the assembly is removable to permit access to the central bore below the jet device 400. To permit installation and removal of the restriction 405, the restriction is equipped with an outwardly biased ring 462 disposable in a profile 463 formed in the interior of the jet device. A seal 463 provides sealing engagement with the jet device housing.

In use, the jet device 400 is run into a wellbore disposed in a working string. Thereafter, as fluid is circulated down the working string and upwards in the annulus 150, a back pressure caused by the restriction causes a portion of the downwardly flowing fluid to be directed into channels and through nozzles 435. As a low-pressure area is created adjacent each nozzle 435, energy is added to fluid in the annulus 150 so that pressure of fluid in the annulus 150 below the assembly 400 is reduced.

From equation 3 it is evident that the Reynolds number is inversely proportional to the fluid viscosity. Everything being equal, higher viscosity gives lower a Reynolds number and corresponding higher coefficient of drag. Higher coefficient of drag causes particles to accelerate faster in the fluid stream until particles attain the same velocity as that of the fluid [$(u_f-u_p)=0$]. Clearly fluid with higher viscosity has a greater capacity to transport cuttings. However, in drilling operations, using viscous fluid causes friction head to be higher thereby increasing ECD. Thus without an ECD reduction tool, using a high viscosity drilling fluid may not be possible under some conditions.

Using a downhole annular pump such as the ECD reduction tool 300, 400, additional methods for completing a wellbore may be provided. In an alternate embodiment, the method includes the step of forming a wellbore to a selected depth. A downhole annular pump is disposed onto a working string, with the working string having a bore therein. The working string is run into the wellbore with a downhole annular pump. From there, fluid is circulated down into the wellbore through the bore of the working string and through the downhole annular pump. Fluid is circulated back up the wellbore through the annulus formed between the working string and the surrounding formation. The downhole annular pump adds energy to the return circulated fluids so as to reduce the hydrostatic head acting in the annular region of the wellbore during drilling. Preferably, the downhole annular pump is actuated by fluid flowing through the working string, i.e., is fluid actuated.

The density of the drilling fluid can be further increased by varying other drilling parameters. For example, the calculated fluid density may be increased in anticipation of decreasing the outer diameter of at least a portion of the working string. Alternatively, the calculated fluid density may be increased in anticipation of decreasing the circulation velocity of the drilling fluid.

The circulating fluid is preferably a drilling fluid; however, the methods claimed herein are not limited to any type of fluid, and may include weighted mud, cement, or other fluid. Similarly for increasing temperature of wellbore fluid, the ECD reduction tool comprising of a downhole turbine and pump assembly described above is not the only option. Heat can also be added to circulated weilbore fluid through other means such as an electric heating element which may be powered by the downhole turbine, a downhole electric motor, or a fluid restrictor.

In connection with a liner hanging and cementing operation, a novel fluid flow restrictor is provided. The fluid flow restrictor is part of a run-in assembly for a liner hanger assembly. More specifically, the fluid flow restrictor is in the form of a constricted flow path through a run-in assembly that serves to heat the fluid.

Each of FIGS. 5A-5F provides a side view of a run-in assembly 500 for a liner hanger assembly 600. Each of these views has a correlating side view of a liner hanger assembly, shown as 600 in FIGS. 6A-6C. Each of FIGS. 6A-6F provides a sectional view of a wellbore 105 with the liner hanger assembly 600 disposed therein. The liner hanger assembly 600 is run into the wellbore 105 using the run-in assembly 500 of FIGS. 5A-5C. In this respect, the liner hanger assembly 600 has a bore 605 configured to receive the run-in assembly 500. Temporary connection is made by connecting a running tool 510 to a matching box or other connector 620 along the liner hanger assembly 600. Typically, the running tool 510 has threads 512 that are rotated into engagement with a matching threaded box along the liner hanger assembly 600.

Figure 5A:
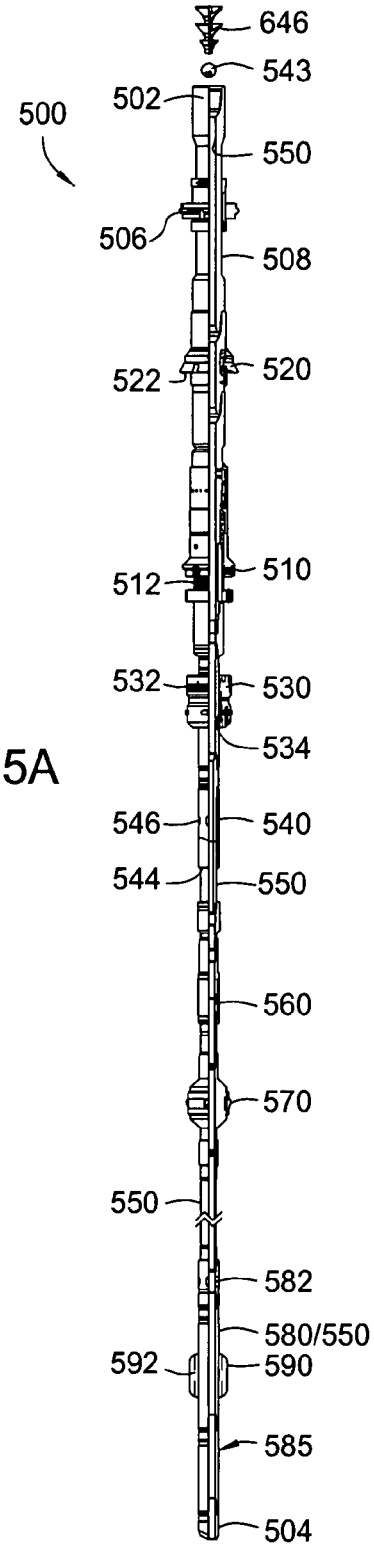
FIGS. 5A-5F provide side views of a run-in assembly for a liner hanger assembly. Each view has a correlating side view of a liner hanger assembly (shown as FIGS. 6A-6C).
Figure 6A:
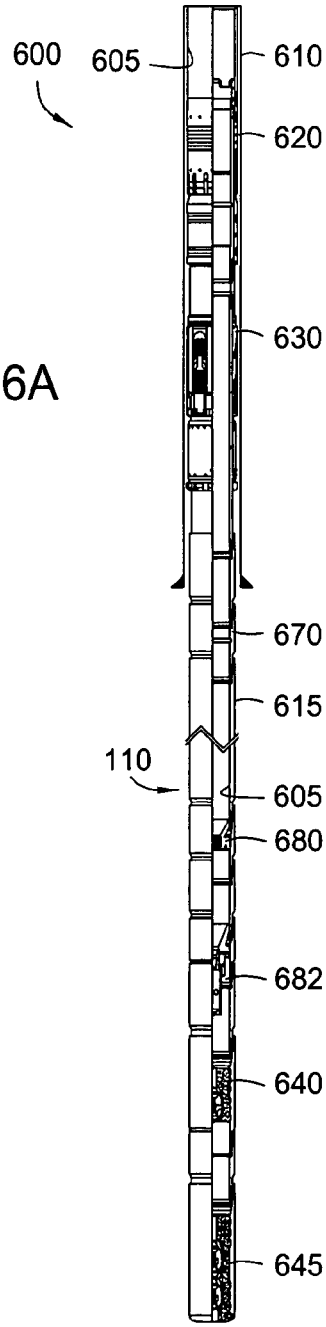
FIGS. 6A-6F each provides a sectional view of a wellbore, with a liner hanger assembly disposed therein. Each view has a correlating side view of a run-in assembly (shown as FIGS. 5A-5C, listed above) for running the liner hanger assembly into the wellbore.
Figure 5B:
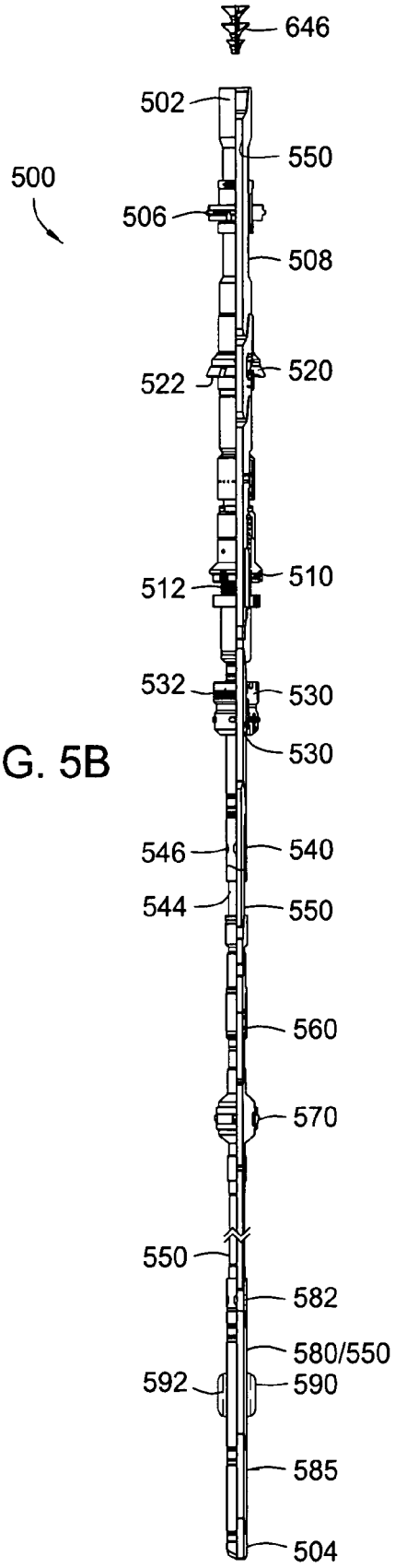
Figure 6B:
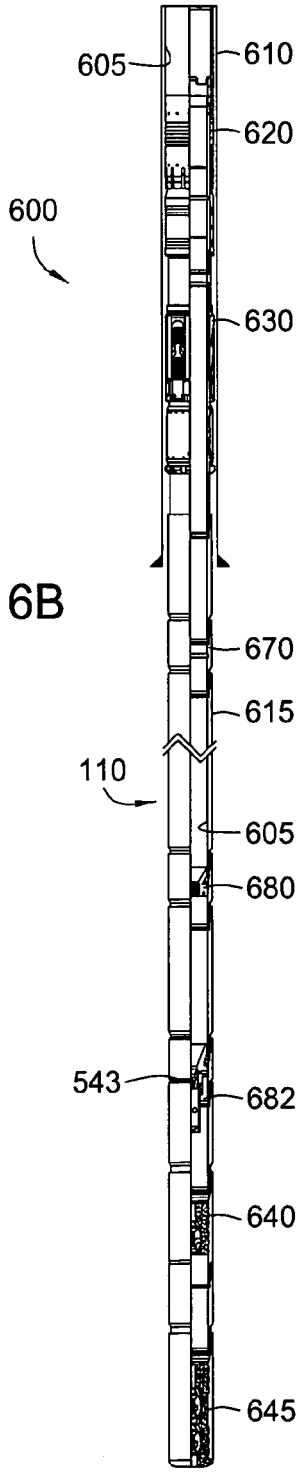

It is noted that FIGS. 5A and 6A are placed on the same drawing sheet, side-by-side. Similarly, FIGS. 5B and 6B, are placed on the same drawing sheet, and so forth. This is to generally demonstrate the cooperative operation of the run-in assembly 500 and the liner hanger assembly 600. However, it is understood that features of the run-in assembly 500 and the liner hanger assembly 600 are not to scale, either internally or with reference to one another. In addition, the relative position of parts between the run-in assembly 500 and the liner hanger assembly 600 is not precise due to space constraints.

Turning now to FIG. 5A, it can be seen that the run-in assembly 500 is an elongated tool having a series of sub-tools therein. The run-in assembly 500 has an upper end 502 in the form of a lift nipple. The lift nipple 502 connects to a working string 120 for run-in. The run-in assembly 500 has a lower end 504 in the form of an entry guide.

As noted, various sub-tools are disposed along the length of the run-in assembly 500. These include an elongated upper support pipe 508, a shear bonnet 506, a packer actuator 520, the running tool 510, and a retrievable seal mandrel 530. These tools are common to many run-in assemblies, and their operations are well-known to those of ordinary skill in the art. It should be noted here that the seal mandrel 530 has a seal member 532 there around for sealing the outer surface of the mandrel 530 with the surrounding liner string 110.

Turning then to FIG. 6A, the liner hanger assembly 600 likewise is an elongated tool having a series of sub-tools therein. The liner hanger assembly 600 has a top end that is a polished bore receptacle 610. A packer 620 is connected below the polished bore receptacle 610. A liner hanger 630, in turn, is connected below the packer 620. The liner string 110 itself is connected below the liner hanger 630. A float collar 640 and a float shoe 645 are provided at a lower end of the liner 110. These sub-tools are also well-known to those of ordinary skill in the art.

The run-in assembly 500 has other features that are not known in other liner hanger operations. The run-in assembly 500 includes an elongated inner pipe 550. An inner seal 534 provides to provide an annular seal between the inner diameter of the mandrel 530 and the outer diameter of the inner pipe 550. The inner pipe 550 is preferably a string of 2⅞" outer diameter pipe joints, though other geometries may be employed. The inner pipe connects to a ported cross-over joint 582. The cross-over joint 582, in turn, is connected to an elongated stinger 580. In one aspect, the stinger 580 is a 100 mm outer diameter slick stinger that extends within the liner 110. The stinger 580 is received within a stinger pack-off 680 appropriately placed within the liner string 110. An annular run-in area 585 is thus formed between the stinger 580 and the surrounding liner 110.

Figure 7A:
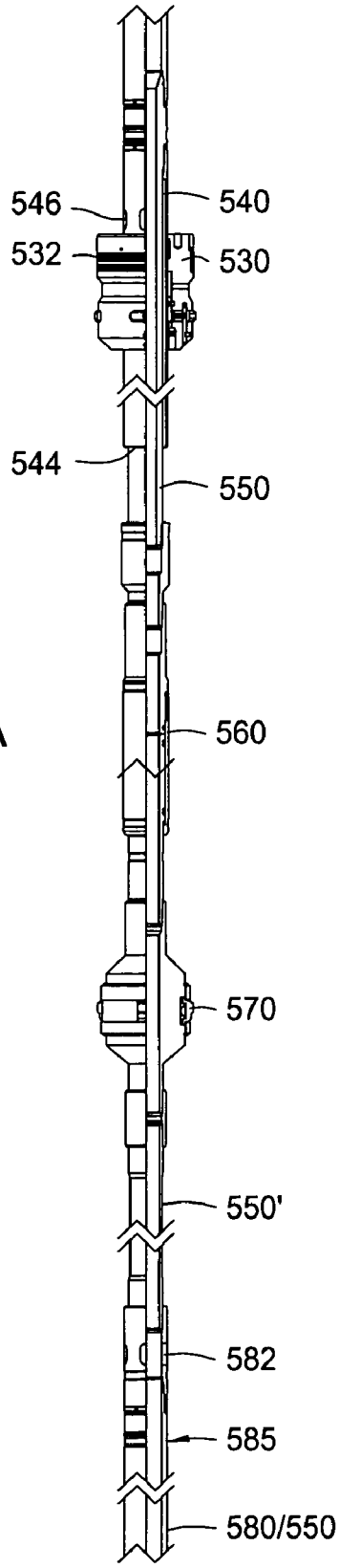
FIG. 7A provides an enlarged view of the run-in assembly of FIG. 5C.

Referring again to the seal mandrel 530, the seal mandrel 530 includes a circulating bypass sleeve 540 having an outer sealing member 532 at the top. The bypass sleeve 540 has upper ports 546 and a lower port 544. In the embodiment of FIGS. 5A and 7A, the lower port 544 defines an open lower end 544 that may receive fluids circulated from below. The open lower end 544 is formed by the lower end of the sleeve 540 itself. The inner pipe 550 extends upward through the bypass sleeve 540 and all the way to the top of the outer pipe member 508 at the lift nipple 502. The inner pipe 550 further extends to the surface where it may be moved relative to the seal mandrel 530 of the run-in assembly 500. A tubing swivel 560 and a mechanical collar locator 570 are each placed below the bypass sleeve 540.

In FIG. 5A, the run-in assembly 500 is in its run-in position relative to the liner hanger assembly 600. In the corresponding FIG. 6A, the liner hanger assembly 600 is thus likewise in its run-in position. It is understood that the run-in assembly 500 is received within a bore 605 in the liner hanger assembly 600.

In operation, the desired number of pipe joints making up the liner 110 is run into the wellbore 105. The liner 110 is then hung in the rotary equipment of the drilling rig (not shown). Next, the desired number of pipe joints making up the inner pipe 550 are made up and run into the liner joints 110. Then, the liner hanger assembly 600 and is made up to the inner pipe 550 and the liner 110. The run-in assembly 500 and connected liner hanger assembly 600 and liner 110 are then run into the wellbore 105 to the desired depth.

In FIG. 5B, the run-in assembly 500 is in position to set the liner hanger 630 and connected liner 110 in the wellbore 105. In the corresponding FIG. 6B, the liner hanger assembly 600 is in position for the liner hanger 630 to be set in the wellbore 105. Circulation is commenced into the working string 120 and through the inner pipe 550. A ball 543 is then dropped through the run-in assembly 500. The ball 543 lands on the landing collar, or "seat" 682. Fluid within the run-in assembly 500 is pressurized to actuate the liner hanger 630 and set the hydraulically set liner hanger 630. The operator will typically slack off weight on the liner hanger 630 to confirm that the liner hanger 630 is set.

Figure 5C:
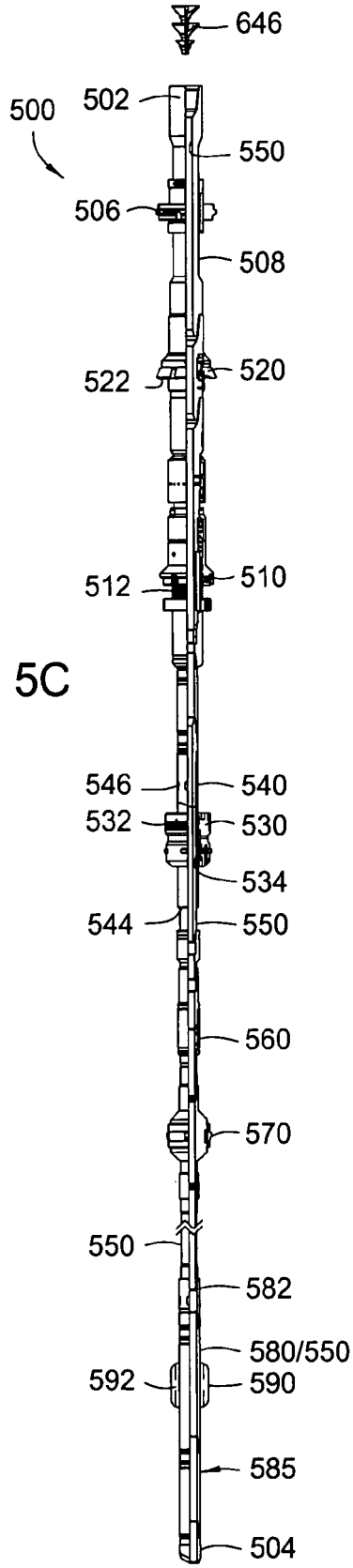
Figure 6C:
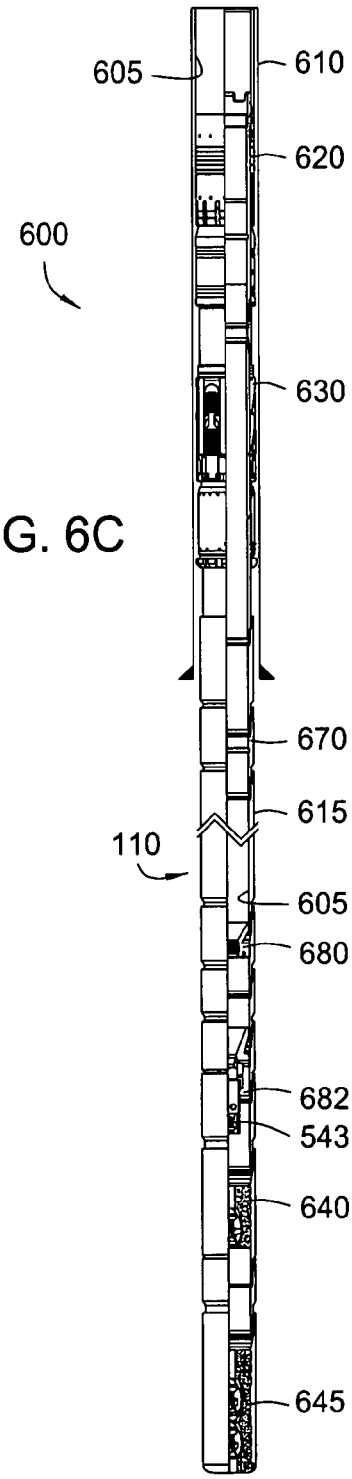

After the liner hanger 630 is set, the run-in assembly 500 is released. The operator picks up the inner pipe 550 until the collar locator 570 latches into a matching profile sub 670 in the liner hanger assembly 600. Preferably, the profile sub 670 is below the liner hanger 630. In FIG. 5C, the collar locator 570 has been latched into the profile sub 670. In doing this, the upper ports 546 in the bypass sleeve 540 are raised above the seal mandrel 530. At the same time, the lower opening 544 at the bottom of the bypass sleeve 540 remains below the seal mandrel 530. In this way, the upper port 546 and the lower opening 544 straddle the seal mandrel 530, allowing fluids to be circulated around the seal mandrel 530. The run-in assembly 500 is thus in position in FIG. 5C for the circulation of fluids in the annular region 585. In this respect, the ball 543 seals the bottom of the stinger 580, forcing fluids to exit the run-in assembly 500 through the cross-over ports 582. Fluids then flow up the annular region 585 within the liner 110 and towards the seal mandrel 530.

Figure 7B:
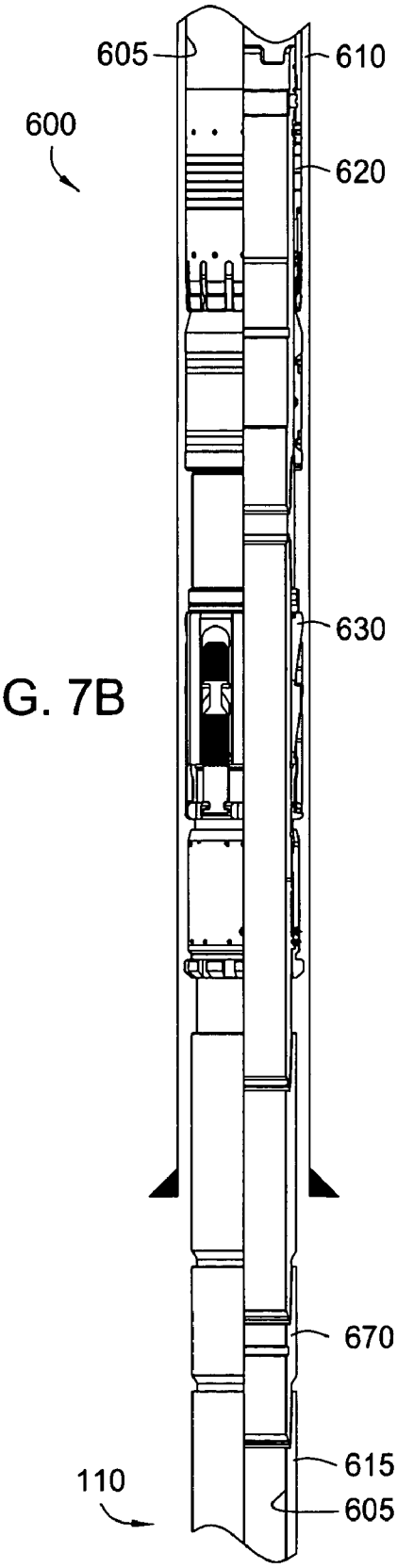
FIG. 7B provides an enlarged view of the liner hanger assembly of FIG. 6C.
Figure 8:
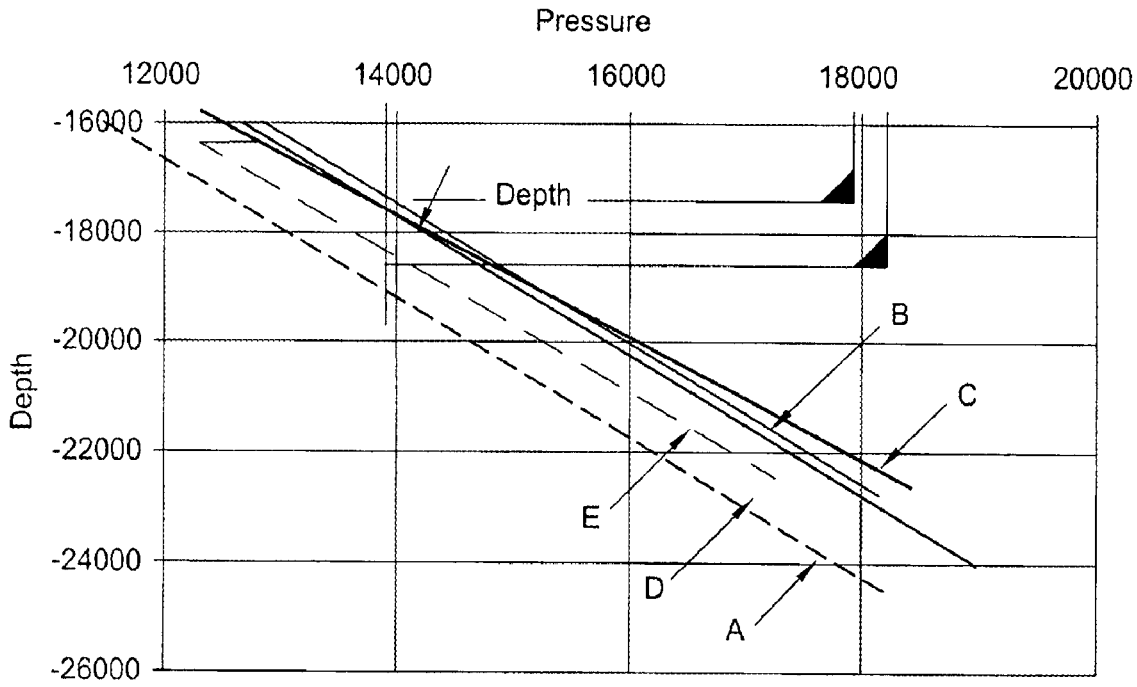

FIG. 7A provides an enlarged view of the run-in assembly 500 of FIG. 5C. Similarly, FIG. 7B provides an enlarged view of the liner hanger assembly 600 of FIG. 6C. In these views, the position of the upper 546 and lower ports 544 relative to the seal mandrel 530 and the liner hanger assembly 600 can be seen. The bypass sleeve 540 has moved upwards relative to the liner hanger assembly 600.

As described above, circulation is initiated in the inner pipe 550. The ball 543 remains seated on the landing seat 682. During circulation down the inner pipe 550, fluids encounter a reduced inner diameter portion of the pipe 550. The reduced inner diameter portion is seen at 550' in FIG. 7A, and may extend for several thousand feet or more. This reduced inner diameter portion acts as a fluid flow restrictor 550', and also serves to increase the temperature of the circulated fluid. The circulated fluid finally exits the inner pipe 550 through the ported cross-over 582.

After exiting the inner pipe 550/580, the fluids travel along the outside of the stinger 580. More specifically, fluids move up the annular region 585 inside the liner 110. Contact between the warmed fluids and the liner 110 creates thermal warming of the surrounding formation along a desired depth. This heat convection, in turn, favorably increases the fracture gradient of the formation 50.

En route to the surface along the annular region 585, the fluids are blocked by the seal member 532 of the mandrel 530. Fluid is thus forced through the lower opening 544 of the bypass sleeve 540 and into the annular region between the inner pipe 550 and the bypass sleeve 540. Fluid flows upwardly through the bypass sleeve 540 and then exits through the upper 546 ports. From there fluid flows to the surface.

It is noted that any type of bypass arrangement for bypassing the seal mandrel 530 may be employed. For example, upper and lower valves may be utilized.

In one aspect, fluid is circulated for about 6 to 12 hours. The length of the liner 110 along which circulation is provided is a matter of engineer's choice. As warmed fluid travels in the annular region 585 adjacent the liner 110 (and, therefore, the surrounding earth formation), the formation is warmed. After a desired time of fluid circulation, circulation is stopped. The inner pipe 550 is slowly lowered back down until the locator collar 570 unlatches from the profile sub 670. The circulating bypass ports 546, 544 of the sleeve 540 are again both below the seal mandrel 530. The shear bonnet 506 is above the polished bore receptacle 610. Pressure is increased in the inner pipe 550 until the ball is blown out of the landing collar 682.

Where drilling mud is used as the circulating fluid, it may be necessary to break circulation. In this respect, the gel strength of the mud may be such that the fluid temporarily sets. Pressure must then be applied through the inner pipe 550 to induce recirculation. The drilling mud is displaced up the liner annulus 615. It is noted here that additional thermal effects are now provided through conduction and convection.

Figure 5D:
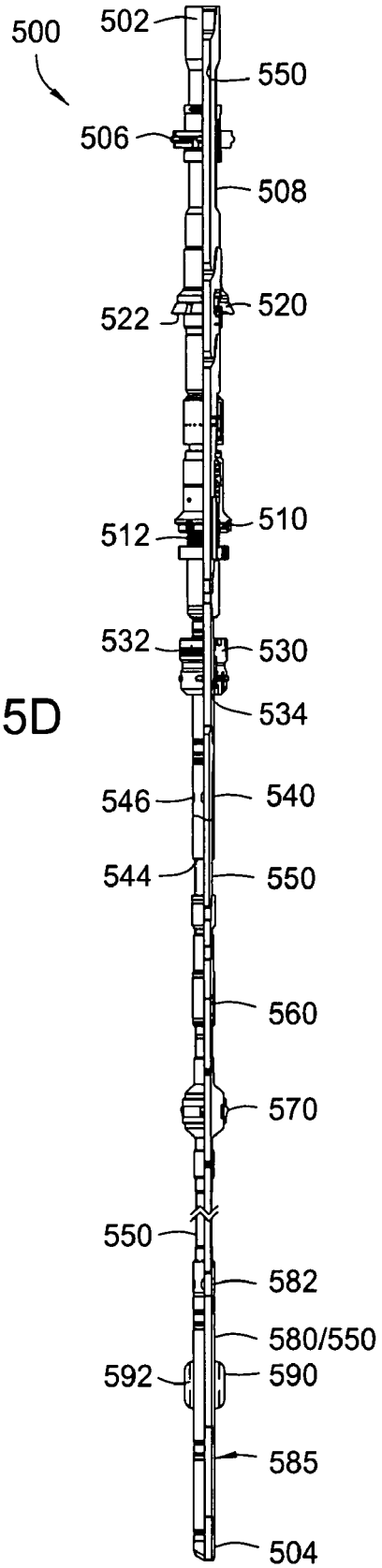
Figure 6D:
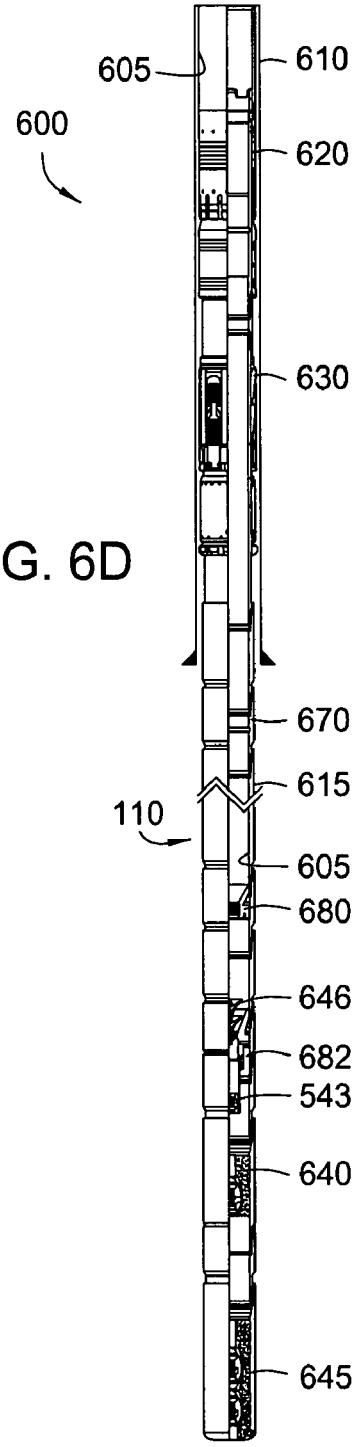

In FIG. 5D, the run-in assembly 500 is in position for the circulation of cement through the inner pipe 550 and the cement shoe 645, and then back up the annular region 615 between the liner 110 and the surrounding earth formation 50. In FIG. 6D, the liner hanger assembly 600 continues to receive the run-in assembly 500. After a desired volume of cement has been injected into the wellbore 105, a cement dart 646 is dropped behind the cement slurry. The dart 646 has fins sized to wipe both the drill pipe 110 and the inner pipe 550. The dart 646 is pumped until landed on the landing collar 682 in the liner assembly 600. In this respect, the dart 646 drops out of the bottom of the guide show 504 of the run-in assembly 500 and onto the landing collar 682.

Figure 5E:
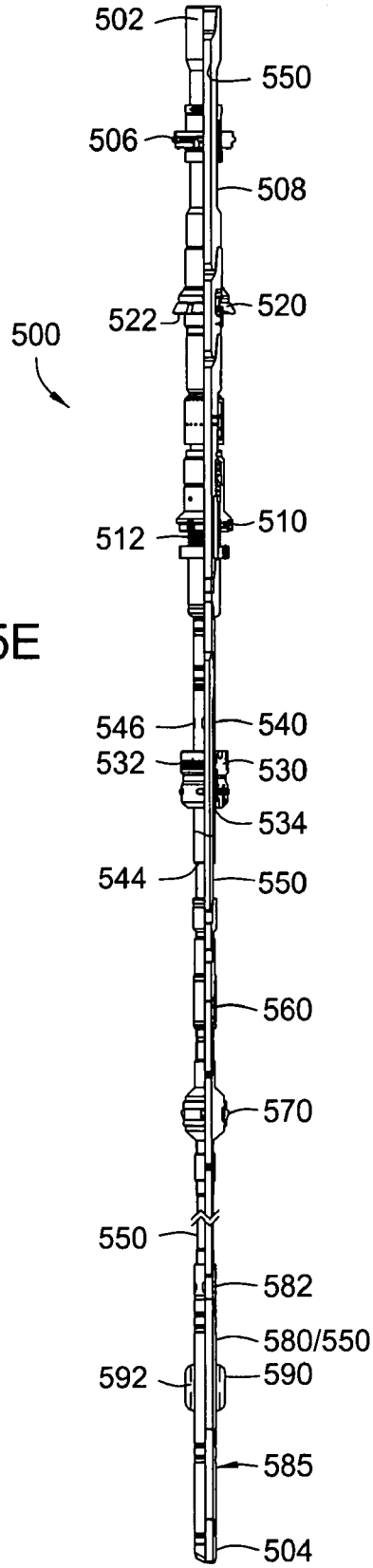
Figure 6E:
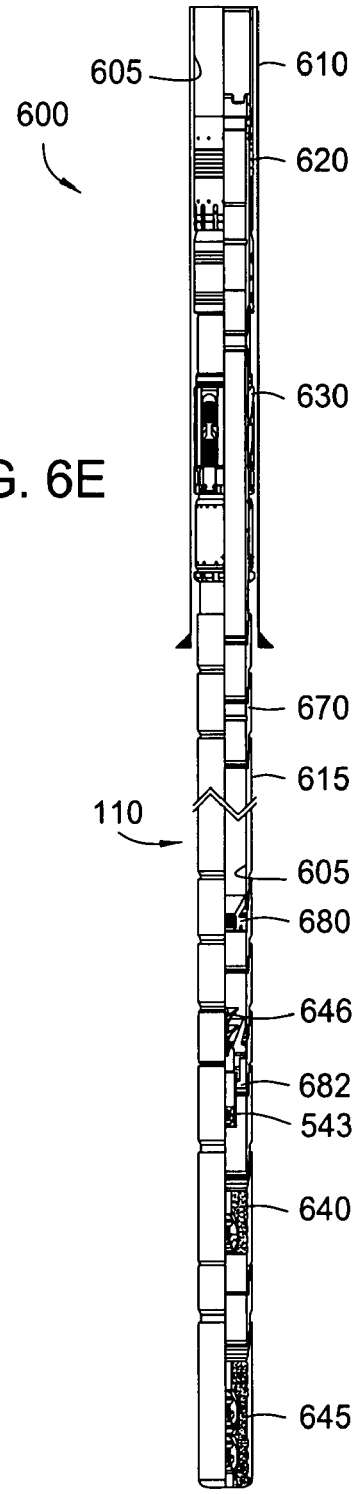

The next step is shown in FIGS. 5E and 6E. In FIG. 5E, the run-in assembly 500 is raised, and is put in position to set the packer 620 along the liner hanger assembly 600. More specifically, the inner pipe 550 is raised until the packer actuator 520 is above the polished bore receptacle 610. Dogs 522 on the packer actuator flange outward to seat on the polished bore receptacle 610. In FIG. 6E, the packer 620 of the liner hanger assembly 600 is being set through mechanical force applied by the run-in assembly 500.

Figure 5F:
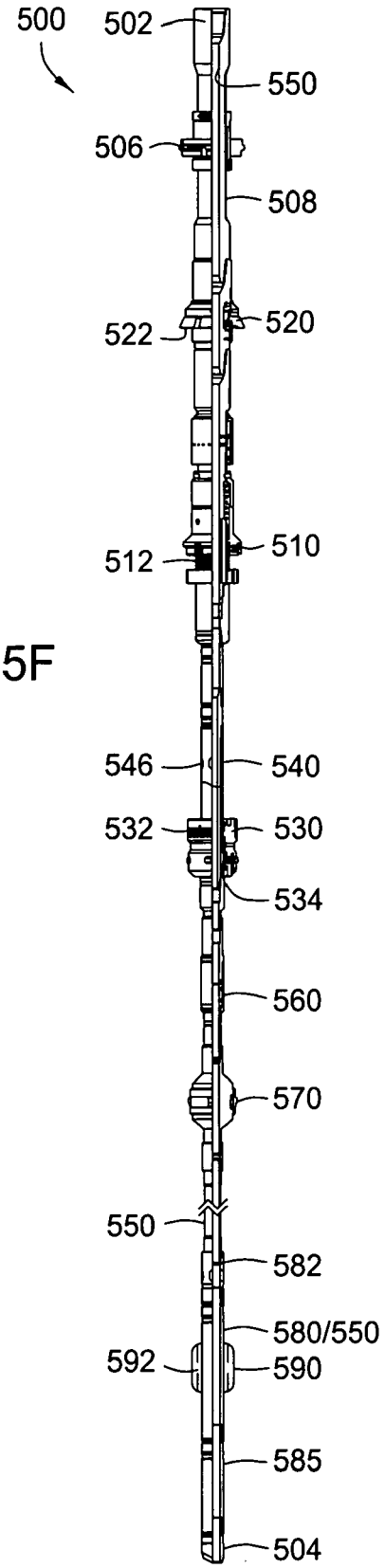
Figure 6F:
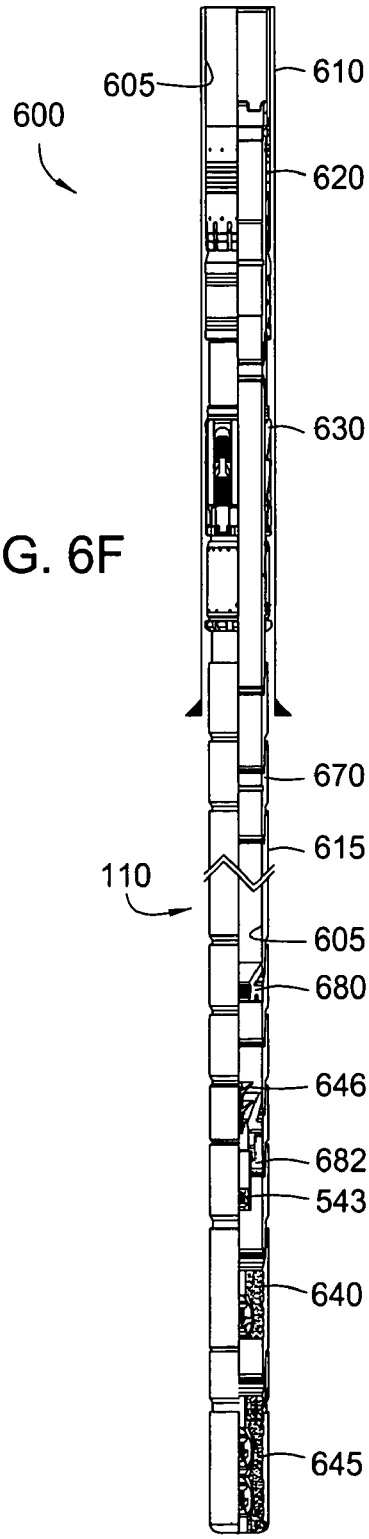

FIGS. 5F and 6F show the run-in assembly 500 being pulled from the liner hanger assembly 600 and the wellbore 105.

As can be seen, in the arrangement of FIGS. 5A-5F a fluid restrictor 550' is provided for a liner hanging/cementing operation in the form of a reduced inner diameter portion for the inner pipe 550. This serves to warm the circulated fluids and, in turn, the surrounding wellbore. Additional fluid heating takes place at least incidentally through fluid agitation as the circulated fluids exit the crossover port 582 in the stinger 580. Still further fluid agitation may optionally be provided by the installation of one or more annular fluid flow restrictors around the stinger 580. One or more annular restrictors 590 may be placed in the annular region 585 between the stinger 580 and the surrounding liner 110. The restrictor 590 will have a bypass flow path 592. In the arrangement of FIG. 5A, the bypass flow path 592 of the restrictor 590 is a plurality of ports. Various other arrangements may be employed, such as spiraled bypass areas (not shown) around an outer diameter of the centralizer.

It should be added that for purposes of the present disclosure, the term "liner" may include any form of pipe, including surface casing. In addition, the methods of the present invention for heating fluid in preparation for a liner cement operation are not limited to use of the above described run-in assembly of FIGS. 5A-5F. The run-in assembly 500 is merely illustrative, and any type of downhole fluid agitator may be used.

While the foregoing is directed to embodiments of the present invention, other and further embodiments of the invention may be devised without departing from the basic scope thereof, and the scope thereof is determined by the claims that follow.

We claim:

1. A method for forming a portion of a wellbore, comprising the steps of:

drilling a well from a first selected depth to a second selected depth to form a bore through a surrounding earth formation;

disposing a fluid heating apparatus along the bore;

heating fluid by moving the fluid through the fluid heating apparatus within the wellbore; and heating the surrounding earth formation by circulating the heated fluid adjacent the earth formation, thereby increasing the fracture resistance of the formation.

2. The method for forming a portion of a wellbore of claim 1, wherein the fluid heating apparatus is a tool that converts hydraulic energy to thermal energy.

3. The method for forming a portion of a wellbore of claim 1, wherein the fluid heating apparatus is a fluid flow restrictor.

4. The method for forming a portion of a wellbore of claim 2, further comprising the steps of:

running a liner into the bore; and cementing the liner in place in the bore after the surrounding formation has been heated along a selected length.

5. The method for forming a portion of a wellbore of claim 4, wherein:

the liner is run into the bore on a liner hanger assembly; and the fluid flow restrictor is disposed on a run-in assembly for the liner hanger assembly.

6. The method for forming a portion of a weilbore of claim 5, wherein the fluid flow restrictor is a reduced inner diameter portion along an elongated inner pipe of the run-in assembly.

7. The method for forming a portion of a weilbore of claim 6, wherein:

the run-in assembly comprises:

the elongated inner pipe;

a retrievable seal mandrel disposed along the inner pipe; and a stinger connected to the elongated inner pipe below the retrievable seal mandrel; and the step of heating the surrounding earth formation is accomplished by circulating the fluid through the inner pipe and connected stinger, and then through an annular region formed between the stinger and the surrounding liner.

8. The method for forming a portion of a wellbore of claim 7, wherein the run-in assembly further comprises at least one annular flow restrictor disposed between the stinger and the surrounding liner, the at least one annular flow restrictor having one or more bypass paths so as to further restrict the flow of and heat the circulated fluid while permitting fluids to flow up the annular region.

9. The method for forming a portion of a wellbore of claim 1, wherein:

the fluid is a drilling fluid;

the fluid heating apparatus is a fluid flow restrictor disposed along a working string, the working string having a bore and also having a drill bit at an end; and the step of heating the surrounding earth formation is accomplished by circulating the drilling fluid through the fluid flow restrictor along on the working string, through the drill bit, and then through an annular region disposed between the working string and the surrounding earth formation.

10. A method for drilling a wellbore, comprising the steps of:

drilling a well to a first selected depth to form a bore through earth formations;

fixing a string of casing in the bore to form a wellbore;

determining formation fracture resistance of the earth formation proximate the bottom of the weilbore;

calculating an equivalent circulating density (ECD) of drilling fluid to offset formation pore pressure proximate the bottom of the wellbore for further drilling without exceeding the formation fracture resistance; and increasing the fluid density above the calculated ECD in anticipation of increased formation fracture resistance when the drilling fluid is heated.

11. The method of claim 10, wherein the step of determining formation fracture resistance is accomplished by performing a leak-off test.

12. The method of claim 10, further comprising the steps of:

running a working string with a drill bit into the wellbore;

drilling the well to a second depth to extend the bore, thereby forming an annular region between the working string and the surrounding earth formation;

circulating drilling fluid having the increased density through the working string and back up the annular region; and heating the drilling fluid in the working string while the drilling fluid is being circulated.

13. The method of claim 12, further comprising the steps of:

adding energy to the drilling fluid circulated in the annular region to reduce hydrostatic pressure on the earth formation; and further increasing the calculated fluid density to compensate for energy added to the drilling fluid in the annular region.

14. The method of claim 12, wherein the step of heating the drilling fluid is accomplished by circulating the fluid through a fluid flow restrictor disposed along the working string.

15. The method of claim 12, further comprising the step of:

further increasing the calculated density in anticipation of decreasing the outer diameter of at least a portion of the working string.

16. The method of claim 12, further comprising the step of:

further increasing the calculated density in anticipation of decreasing the circulation velocity of the drilling fluid.

17. The method of claim 13, wherein the step of drilling the well to a second depth comprises the steps of:

running a working string into the wellbore, the working string having a bore therein, and a drill bit disposed at the end of the working string; and rotating the drill bit; and wherein the step of heating the drilling fluid and the step of adding energy to the drilling fluid are each performed by actuating a downhole turbine and connected annular pump disposed along the working string.

18. The method of claim 17, wherein the downhole annular pump comprises:

a stator;

a rotor disposed in the stator, the rotor having a bore there though to permit the drilling fluid to flow there through while the drilling fluid is being circulated through the working string;

an annular path around the rotor, the annular path permitting the drilling fluid to pass through the pump while the fluid is being circulated through an annular region between the working string and the surrounding wellbore; and blade members on the rotor constructed and arranged to act upon and urge fluid traveling in the annular region.

19. The method of claim 18, wherein the circulation of drilling fluid through the rotor heats the drilling fluid, and also actuates rotational movement of the blade members to add energy to the fluid traveling in the annular region.

20. A method for completing a wellbore, comprising the steps of:

forming a wellbore to a selected depth;

disposing a fluid heating apparatus along a working string, the working string having a bore therein;

running the working string into the wellbore;

circulating fluid down into the wellbore through the bore of the working string and through the fluid heating apparatus;

circulating fluid back up the wellbore through an annulus formed between the working string and the surrounding wellbore.

21. The method of claim 20, wherein the fluid heating apparatus is a fluid flow restrictor.

22. The method of claim 21, wherein the fluid flow restrictor is a downhole annular pump.

23. The method of claim 22, wherein the pump comprises:

a stator; and a rotor disposed in the stator.

24. The method of claim 23, wherein the pump further comprises:

a motor operatively connected to the rotor; and the rotor has a bore there though to permit fluid to pass the motor in a first direction.

25. The method of claim 24, wherein the rotor is rotated by fluid pumped through the working string and motor, and wherein the pump further comprises:

an annular path around the rotor, the annular path permitting the circulating fluid to pass through the pump in a second direction; and fluid urging means to urge the fluid in the second direction as it passes through the annular path.

26. The method of claim 25, wherein the fluid urging means includes undulations formed on an outer surface of the rotor and conforming undulations formed on an inner surface of a stator portion, the undulations and conforming undulations forming the path through the motor and urging the fluid in the second direction as the rotor rotates relative to the stator portion.

27. The method of claim 26, wherein one side of the undulations of the rotor include blade members helically formed thereon, the blade members constructed and arranged to act upon and urge fluid traveling in the passage.

28. The method of claim 22, wherein the pump is a centrifugal pump that adds energy to the circulated fluid by urging circulated fluid in the annulus upwards.

29. The method of claim 22, wherein the pump is a venturi pump that adds energy to the circulated fluid by urging circulated fluid in the annulus upwards.

30. The method of claim 21, wherein the fluid flow restrictor is a progressive cavity motor.

31. The method of claim 24, wherein the rotor is an electrically actuated motor.

32. The method of claim 20, wherein the circulating fluid is drilling fluid.

33. The method of claim 32 wherein the drilling fluid is a weighted mud.

34. The method of claim 20, wherein the circulating fluid is cement.

35. The method of claim 20, wherein the fluid heating apparatus is a downhole electrical coil.

36. A method for completing a wellbore, comprising the steps of:

running a working string into a bore in the earth, the working string having a bore therein, and a drill bit disposed proximate an end of the working string;

rotating the working string to drill through an earth formation;

circulating a drilling fluid while rotating the drill bit, the fluid being circulated in a first direction through the bore of the working string and the drill bit, and in a second direction through an annular region formed between the working string and the surrounding earth formation;

heating the drilling fluid through a flow restriction process while the drilling fluid is being circulated through the working string; and adding energy to the drilling fluid traveling in the annulus to reduce the hydrostatic head in the wellbore.

37. The method of claim 36, wherein the steps of heating the drilling fluid and adding energy to the drilling fluid are each performed by circulating fluid through a downhole turbine and connected annular pump disposed along the working string.

38. The method of claim 37, wherein the downhole annular pump comprises:

a stator;

a rotor disposed in the stator, the rotor having a bore there though to permit fluid to past the motor in the first direction;

a motor operatively connected to the rotor;

an annular path around the rotor, the annular path permitting the circulating fluid to pass through the pump in the second direction; and blade members on the rotor constructed and arranged to act upon and urge fluid traveling in the second direction.

39. The method of claim 38, wherein the circulation of drilling fluid through the rotor in the first direction actuates rotational movement of the blade members to add energy to the fluid traveling in the second direction.

40. A run-in assembly for a liner hanger assembly, the liner hanger assembly having a liner hanger for hanging a liner, the run-in assembly comprising:

a running tool releasably connectible to the liner hanger assembly;

an elongated pipe extending below the running tool configured to be placed within the liner, thereby forming an annular region between the elongated pipe and the surrounding liner; and a fluid heating apparatus disposed along the elongated pipe such that the circulation of fluids through the elongated pipe.

41. The run-in assembly of claim 40, wherein the fluid heating apparatus is a fluid flow restrictor defined by a reduced inner diameter portion of the elongated pipe.

42. The run-in assembly of claim 41, wherein:

the run-in assembly further comprises a retrievable seal mandrel; and the elongated pipe comprises:

an inner pipe portion along the retrievable seal mandrel;

a crossover port joint connected to the inner pipe at a lower end; and a stinger portion connected to the crossover port joint.

43. The run-in assembly of claim 42, further comprising:

an annular fluid flow restrictor in the annular area.

44. The run-in assembly of claim 40, further comprising:

a circulating bypass apparatus along the inner pipe for selectively bypassing the seal mandrel.

45. The run-in assembly of claim 44, wherein the circulating bypass apparatus defines an upper port and a lower port, and being movable relative to the retrievable seal mandrel to permit the upper and lower ports to selectively straddle the retrievable seal mandrel so that circulated fluids may bypass the retrievable seal mandrel when circulated back to a surface.

46. The run-in assembly of claim 44, wherein the circulating bypass apparatus defines a first valve below the retrievable seal mandrel, and a second valve disposed above the retrievable seal mandrel.

* * * * *

UNITED STATES PATENT AND TRADEMARK OFFICE

CERTIFICATE OF CORRECTION

PATENT NO. : 7,306,042 B2
APPLICATION NO. : 10/911223
DATED : December 11, 2007
INVENTOR(S) : Bansal et al.

It is certified that error appears in the above-identified patent and that said Letters Patent is hereby corrected as shown below:

On the Title Page, Item -56-

Page 2, please insert --5,211,223 A 5/1993 Mulville--.

Signed and Sealed this

Twenty-fourth Day of June, 2008

JON W. DUDAS
*Director of the United States Patent and Trademark Office*